US008657333B2

(12) United States Patent
Young et al.

(10) Patent No.: US 8,657,333 B2
(45) Date of Patent: Feb. 25, 2014

(54) INFLATOR DEVICE WITH FUEL-RICH MONOLITHIC GRAIN AND OXIDANT-ENHANCED COMBUSTION

(75) Inventors: Anthony M. Young, Malad, ID (US); Gary K. Lund, Malad, ID (US); Kenneth J. Clark, Morgan, UT (US); Brett Hussey, Bountiful, UT (US)

(73) Assignee: Autoliv ASP, Inc., Ogden, UT (US)

( * ) Notice: Subject to any disclaimer, the term of this patent is extended or adjusted under 35 U.S.C. 154(b) by 154 days.

(21) Appl. No.: 13/192,050

(22) Filed: Jul. 27, 2011

(65) Prior Publication Data

US 2013/0026742 A1 Jan. 31, 2013

(51) Int. Cl.

| | |
|---|---|
| ***B60R 21/272*** | (2006.01) |
| ***B60R 21/274*** | (2011.01) |
| ***B60R 21/26*** | (2011.01) |
| ***B60R 21/268*** | (2011.01) |

(52) U.S. Cl.

USPC ..... 280/737; 280/736; 280/741

(58) Field of Classification Search

USPC ..... 280/736, 737, 741, 742; 102/530, 531, 102/202.14; 149/61, 74.1, 19.4, 19.7

See application file for complete search history.

(56) References Cited

U.S. PATENT DOCUMENTS

| | | | | |
|---|---|---|---|---|
| 5,094,475 | A * | 3/1992 | Olsson et al. | 280/730.2 |
| 5,441,302 | A | 8/1995 | Johnson et al. | |
| 5,585,597 | A * | 12/1996 | Faigle et al. | 102/530 |
| 5,590,906 | A * | 1/1997 | Faigle et al. | 280/741 |
| 5,762,368 | A * | 6/1998 | Faigle et al. | 280/737 |
| 5,762,369 | A | 6/1998 | Mooney et al. | |
| 5,871,231 | A * | 2/1999 | Richards et al. | 280/735 |
| 5,872,329 | A * | 2/1999 | Burns et al. | 149/36 |
| 5,979,936 | A * | 11/1999 | Moore et al. | 280/736 |
| 6,093,269 | A | 7/2000 | Lundstrom et al. | |
| 6,238,500 | B1 * | 5/2001 | Blomquist | 149/74 |
| 6,332,404 | B1 * | 12/2001 | Rink et al. | 102/530 |

(Continued)

FOREIGN PATENT DOCUMENTS

| | | |
|---|---|---|
| CN | 102897136 A | 1/2013 |
| CN | 102898262 A | 1/2013 |

(Continued)

OTHER PUBLICATIONS

Communication mailed Jul. 24, 2013 enclosing the European Search Report and European Search Opinion dated Jul. 16, 2013 for European App. No. 12005382.2 (Pub. No. EP 2551629).

*Primary Examiner* — Toan To
*Assistant Examiner* — George Spisich
(74) *Attorney, Agent, or Firm* — Harness, Dickey & Pierce, P.L.C.

(57) ABSTRACT

The disclosure provides an inflator device for a passive restraint device, like an airbag. In certain aspects, a fuel-rich gas generant grain is located in actuating proximity to an initiator device. The grain has at least one flow channel through which a shock wave generated by the initiator device passes. The shock wave opens a burst disc between the inflator housing and downstream airbag to permit gases to flow into the airbag. A chamber storing pressurized gas (having at least one oxidant, e.g., $O_2$) is also disposed within the inflator. Upon initiator actuation, the oxidant can react with combustion products of the initiator and the fuel-rich gas generant and flow into the airbag for rapid inflation. Methods of inflating airbags and improving airbag deployment reliability are provided. Such inflators are particularly suitable for large volume (greater than 60 liter) airbags.

33 Claims, 6 Drawing Sheets

(56) References Cited

U.S. PATENT DOCUMENTS

| | | | | |
|---|---|---|---|---|
| 6,435,552 | B1 | 8/2002 | Lundstrom et al. | |
| 6,605,233 | B2 * | 8/2003 | Knowlton et al. | 252/181.1 |
| 6,634,302 | B1 * | 10/2003 | Rink et al. | 102/530 |
| 6,645,326 | B2 | 11/2003 | Canterberry et al. | |
| 6,726,243 | B2 | 4/2004 | Dinsdale et al. | |
| 6,764,097 | B2 | 7/2004 | Kelley et al. | |
| 6,789,485 | B2 * | 9/2004 | Moquin et al. | 102/530 |
| 6,857,657 | B2 * | 2/2005 | Spangler et al. | 280/737 |
| 6,893,517 | B2 | 5/2005 | Zeuner et al. | |
| 6,942,743 | B2 | 9/2005 | Rink et al. | |
| 6,958,101 | B2 | 10/2005 | Mendenhall et al. | |
| 6,962,365 | B2 * | 11/2005 | Rink et al. | 280/736 |
| 7,147,733 | B2 | 12/2006 | Barnes et al. | |
| 7,210,703 | B2 * | 5/2007 | Young et al. | 280/741 |
| 7,343,862 | B2 * | 3/2008 | McCormick | 102/530 |
| 7,413,217 | B2 * | 8/2008 | Nakayasu et al. | 280/737 |
| 7,648,163 | B2 * | 1/2010 | Hanano et al. | 280/736 |
| 7,758,709 | B2 | 7/2010 | Hussey et al. | |
| 7,883,108 | B2 * | 2/2011 | Robinette et al. | 280/736 |
| 2002/0056976 | A1 * | 5/2002 | Nakashima et al. | 280/741 |
| 2003/0145926 | A1 | 8/2003 | Zeuner et al. | |
| 2003/0160438 | A1 * | 8/2003 | Quioc et al. | 280/741 |
| 2004/0222620 | A1 * | 11/2004 | Wang et al. | 280/737 |
| 2006/0103123 | A1 * | 5/2006 | Myers | 280/736 |
| 2006/0255577 | A1 | 11/2006 | Nakayasu et al. | |
| 2006/0289096 | A1 | 12/2006 | Mendenhall et al. | |
| 2007/0084532 | A1 * | 4/2007 | Burns et al. | 149/24 |
| 2008/0023948 | A1 * | 1/2008 | Kitayama et al. | 280/736 |
| 2008/0272204 | A1 | 11/2008 | McNichols et al. | |
| 2009/0008001 | A1 | 1/2009 | Mendenhall et al. | |
| 2009/0020197 | A1 | 1/2009 | Hosey | |
| 2009/0044886 | A1 | 2/2009 | Brisighella et al. | |
| 2010/0052299 | A1 | 3/2010 | Robinette et al. | |
| 2010/0096844 | A1 * | 4/2010 | Staheli et al. | 280/741 |
| 2011/0041969 | A1 | 2/2011 | Marlin et al. | |
| 2011/0076228 | A1 | 3/2011 | Kelly et al. | |
| 2013/0025749 | A1 | 1/2013 | Lund | |
| 2013/0199399 | A1 | 8/2013 | Young et al. | |

FOREIGN PATENT DOCUMENTS

| | | | |
|---|---|---|---|
| EP | 0844146 | A1 | 5/1998 |
| EP | 2551253 | A2 | 1/2013 |
| EP | 2551629 | A2 | 1/2013 |
| GB | 638893 | A | 6/1950 |
| WO | 2008/145935 | A2 | 12/2008 |

* cited by examiner

--Prior Art--

--Prior Art--

INFLATOR DEVICE WITH FUEL-RICH MONOLITHIC GRAIN AND OXIDANT-ENHANCED COMBUSTION

FIELD

The present disclosure relates to inflators devices for passive restraint air bag systems employing oxidant-enhanced combustion and a fuel-rich monolithic grain.

BACKGROUND

This section provides background information related to the present disclosure which is not necessarily prior art.

Passive inflatable restraint systems are often used in a variety of applications, such as in motor vehicles. When a vehicle decelerates due to a collision or another triggering event occurs, an inflatable restraint system deploys an airbag cushion to prevent contact between the occupant and the vehicle to minimize occupant injuries. Airbag systems typically include an inflator that can be connected to the one or more inflatable airbags positioned within the vehicle, and can rapidly produce a quantity of inflation fluid or gas that can fill the airbag(s) to protect the occupant(s). Such inflatable airbag cushions may desirably deploy into one or more locations within the vehicle between the occupant and certain parts of the vehicle interior, such as the doors, steering wheel, instrument panel, headliner, or the like, to prevent or avoid the occupant from forcibly striking such parts of the vehicle interior during collisions or roll-overs. In particular, driver side and passenger side inflatable restraint installations have found wide usage for providing protection to drivers and front seat passengers, respectively, in the event of head-on types of vehicular collisions. Further, side impact inflatable restraint installations have been developed to provide improved occupant protection against vehicular impacts inflicted or imposed from directions other than head-on, e.g., "side impacts." Thus, a vehicle can include an inflatable curtain airbag deployed from a headliner of the vehicle, which can inflate to protect the head of the occupant(s) from contact with the side of the vehicle, such as the windows in the event of a sudden deceleration or roll-over. One or more of such inflatable safety restraint devices can be found on most new vehicles.

One particularly common type of inflator device for an airbag system generates gas for the airbag cushion by combustion of a pyrotechnic gas generating material. Another common form or type of inflator device contains a quantity of stored pressurized or compressed gas for release into an airbag. However, such stored gas inflators are typically only useful to inflate airbags with small volumes. Yet another type of a compressed gas inflator is commonly referred to as a "hybrid inflator," which can supply inflation gas as a result of a combination of stored compressed gas and combustion products resulting from the combustion of a gas generating pyrotechnic material.

As passive restraint systems become incorporated into more applications within vehicles, it would be desirable to have inflator devices that can fill and deploy airbag cushions having larger volumes than those presently used, especially for side-impact and roll-over restraint systems. However, providing adequate inflation to such large volume airbag cushions within the required time has been a particular challenge. It would be desirable to provide a relatively small, lightweight and economical inflator device, such as a hybrid inflator device, for an airbag cushion that exhibits superior and improved inflation performance.

SUMMARY

This section provides a general summary of the disclosure, and is not a comprehensive disclosure of its full scope or all of its features.

In various aspects, the present disclosure provides an inflator device for an airbag. In certain variations, the inflator device comprises a housing including an initiator device in actuating proximity to a fuel-rich gas generant grain that produces a combustion gas to inflate the airbag. The fuel-rich gas generant grain defines at least one flow channel from a first side to a second opposite side. The housing further comprises a chamber that stores a pressurized gas. In certain aspects, the pressurized stored gas comprises at least one gaseous oxidizer capable of reacting with the gas products produced by the fuel-rich gas generant grain. In certain embodiments, the fuel-rich gas generant grain is at least partially disposed within the chamber storing the pressurized gas. In other alternative variations, the fuel-rich gas generant grain can be disposed in an isolated second pyrotechnic chamber or compartment, where further mixing and combustion can occur in a separate mixing region located between the second pyrotechnic compartment and first stored gas chamber, for example. Further, the inflator device also comprises a temporary closure disposed in the housing to restrict fluid communication between the chamber storing pressurized gas and the airbag. Upon actuation, the initiator device generates a shock wave that propagates through the one or more flow channels in the fuel-rich gas generant grain to open the temporary closure and permit fluid communication between the chamber and the airbag, so that the airbag may be inflated by a portion of the combustion gas and/or a portion of the pressurized stored gas. Such an inflator device is particularly well-suited for inflating airbags having fill volume of greater than or equal to about 45 liters, optionally greater than or equal to about 60 liters, and in certain embodiments, greater than or equal to about 75 liters.

In other aspects, the present disclosure provides an inflator device for an airbag that comprises a housing. The housing comprises an initiator device in actuating proximity to a fuel-rich gas generant grain that produces a combustion gas to inflate the airbag. The fuel-rich gas generant grain defines at least one flow channel from a first side to a second opposite side. In certain embodiments, the fuel-rich gas generant grain is at least partially disposed within the chamber storing the pressurized gas. In other alternative variations, the fuel-rich gas generant grain can be disposed in an isolated second pyrotechnic chamber or compartment, where further mixing and combustion can occur in a separate mixing region located between the second pyrotechnic compartment and first stored gas chamber, for example. The pressurized gas comprises at least one gaseous oxidizer comprising oxygen ($O_2$) at greater than or equal to 1 mole % to less than or equal to about 20 mole %. Further, in certain aspects, the stored pressurized gas has an average molecular weight of greater than or equal to about 20 grams per mole (g/mol) to less than or equal to about 40 g/mol. The gaseous oxidizer is capable of reacting with the gas products produced by the fuel-rich gas generant grain. Further, a temporary closure is disposed in the housing to restrict fluid communication between the chamber and the airbag. Upon actuation, the initiator device generates a shock wave that propagates through the flow channel(s) of the fuel-rich gas generant grain so as to open a temporary closure to permit fluid communication between the chamber and the airbag. Thus, at least a portion of the pressurized gas and the combustion gas enters the airbag for inflation. Such an inflator device is particularly well-suited for inflating airbags having fill volume of greater than or equal to about 45 liters, optionally greater than or equal to about 60 liters, and in certain embodiments, greater than or equal to about 75 liters.

In yet other aspects, the present disclosure provides methods for inflating an airbag. In one particular variation, the method comprises providing an initiator device in actuating proximity to a fuel-rich gas generant grain that defines at least one flow channel from a first side to a second opposite side. In certain embodiments, the fuel-rich gas generant grain is at least partially disposed within a chamber storing a pressurized gas comprising at least one gaseous oxidizer capable of reacting with the gas products produced by the fuel-rich gas generant grain. In other alternative variations, the fuel-rich gas generant grain can be disposed in an isolated second pyrotechnic chamber or compartment, where further mixing and combustion can occur in a separate mixing region located between the second pyrotechnic compartment and first stored gas chamber, for example. Upon actuating the initiator device, a shock wave is generated that propagates through the flow channel(s) of the fuel-rich gas generant grain, so as to open a temporary closure. Once the temporary closure is opened, fluid communication occurs between the chamber and the airbag. After actuating the initiator device, at least a portion of the fuel-rich gas generant material or gas products produced by the fuel-rich gas generant grain react with the gaseous oxidizer react to generate a combustion gas, so that the airbag is inflated by the combustion gas and at least a portion of the pressurized stored gas.

In yet other variations, an inflator device for an airbag is provided that includes a housing comprising an initiator device in actuating proximity to a gas generant grain comprising at least one flow channel. The gas generant grain produces a combustion gas to inflate the airbag. The housing further comprises a chamber storing a pressurized gas comprising at least one gaseous oxidizer. The gaseous oxidizer is capable of reacting with a component contained in or generated by either the initiator device or the gas generant grain. In certain variations, the pressurized gas has an average molecular weight of greater than or equal to about 20 g/mol to less than or equal to about 40 g/mol. A temporary closure is also disposed in the housing to restrict fluid communication between the chamber and the airbag. Upon actuation, the initiator device generates a shock wave that propagates through the at least one flow channel of the gas generant grain so as to open the temporary closure to permit fluid communication between the chamber and the airbag.

In yet other aspects, the present teachings provide a method of improving reliability of an airbag system. In certain variations, the method of improving reliability is conducted by providing an airbag inflator comprising an initiator device in actuating proximity to a gas generant grain comprising at least one flow channel. A pressurized gas, comprising at least one gaseous oxidizer, is introduced into a storage chamber. The pressurized gas optionally has an average molecular weight of greater than or equal to about 20 g/mol to less than or equal to about 40 g/mol, in certain variations. The initiator device is capable of generating a shock wave upon actuation that propagates through the flow channel(s) of the gas generant grain so as to open a temporary closure to permit fluid communication between the storage chamber and the airbag to deploy the airbag. The introducing of the at least one gaseous oxidizer into the stored pressurized gas and its presence through actuation serves to improve airbag deployment reliability.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
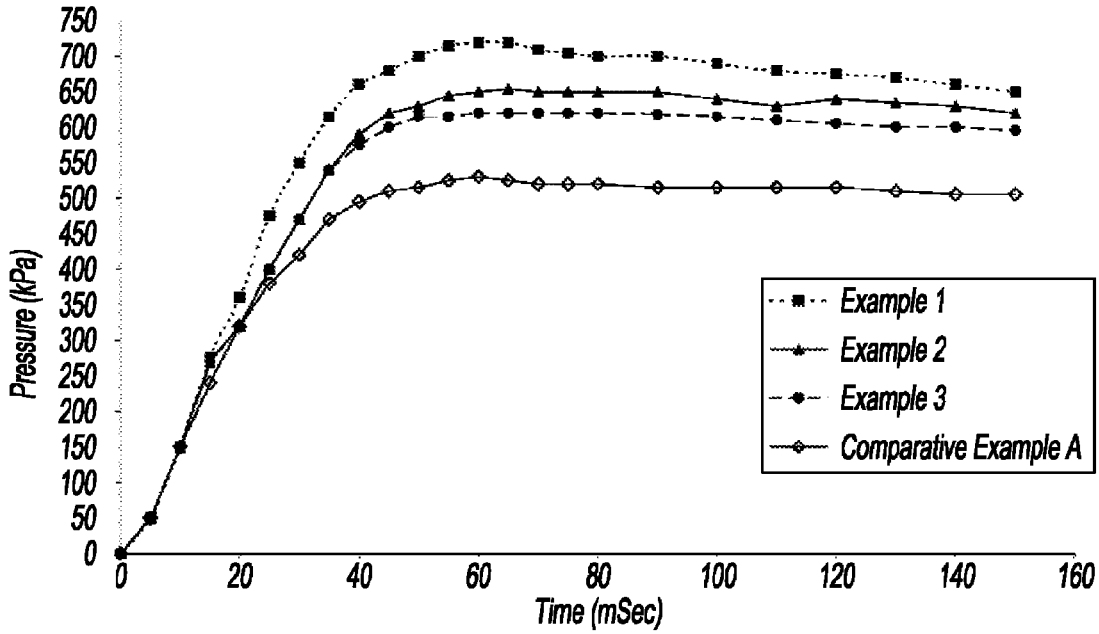
Figure 7:
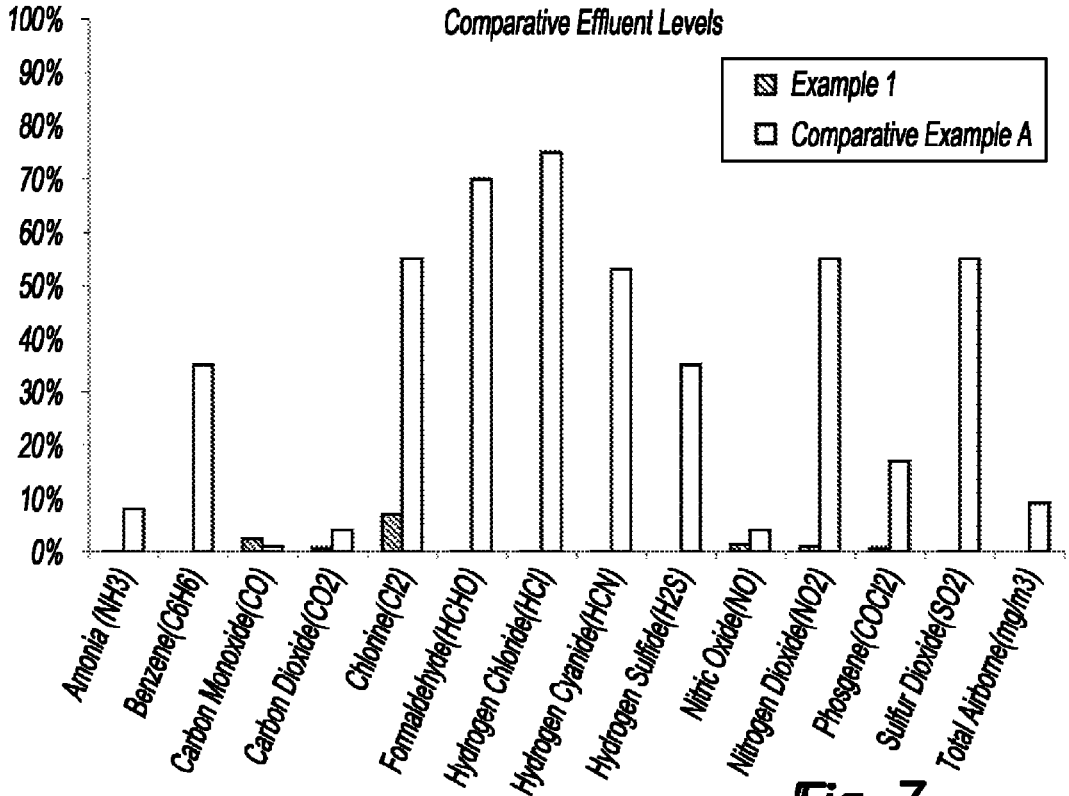
Figure 8:
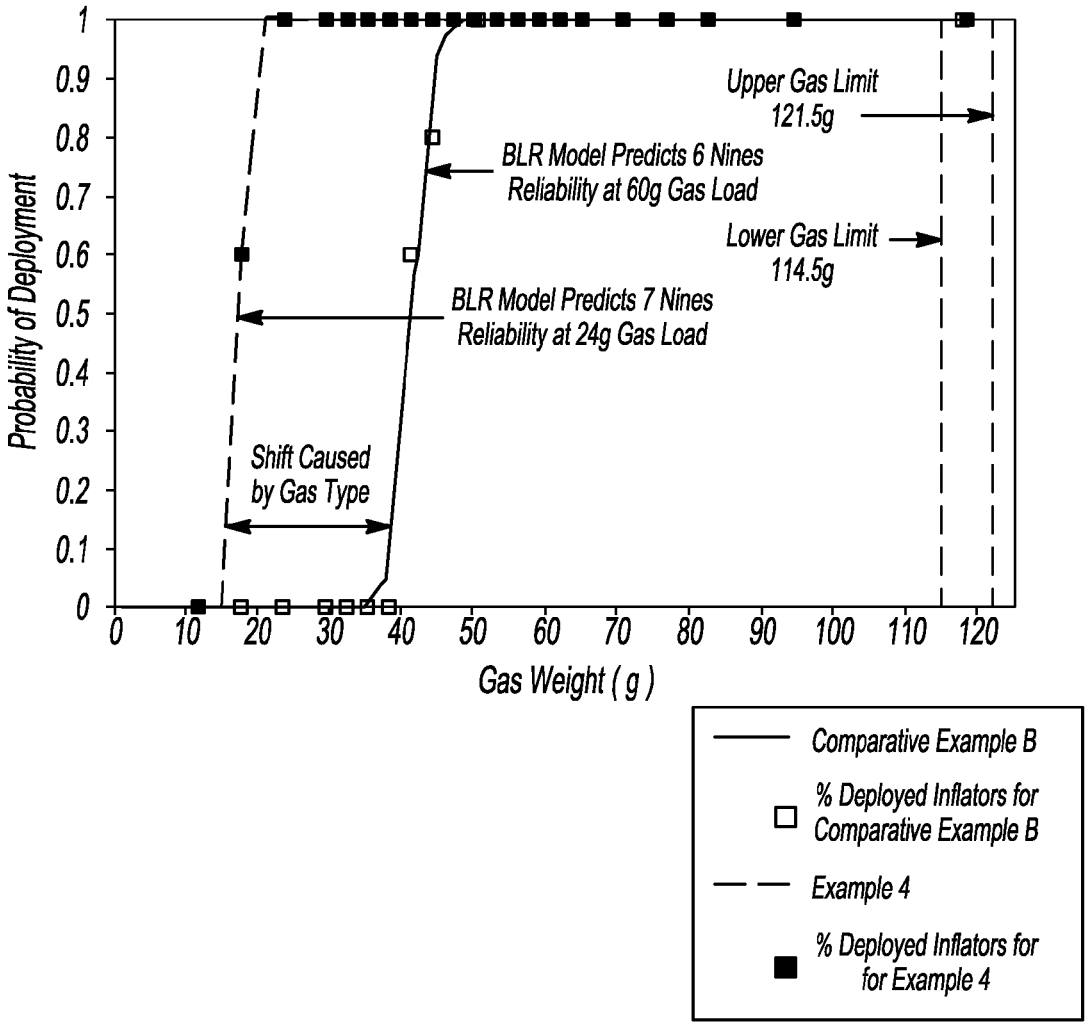

FIG. 6 is a graph of combustion pressure versus time, comparing an inflator device including examples of fuel-rich monolithic gas generant grains and a stored compressed gas having at least one oxidant according to certain embodiments of the present disclosure with a comparative inflator device employing a monolithic gas generant grain having stoichiometric proportions of fuel to oxidant stored in an inert gas mixture;

FIG. 7 is a comparative chart of noxious regulated effluent species produced (% of allowed limits for each species) by a conventional comparative inflator device and an inflator device according to certain aspects of the present teachings, including a fuel-rich monolithic gas generant grain and a stored compressed gas having at least one oxidant and a comparative inflator device employing a monolithic gas generant grain having stoichiometric proportions of fuel to oxidant stored in an inert gas; and FIG. 8 is a comparative chart of deployment reliability for comparative inflator devices determined by a Binary Logistic Regression model showing the statistical probability of deployment versus gas weight for an inflator device having a stored compressed gas having at least one oxidant as compared to a comparative inflator device having an inert compressed gas storage media.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As referred to herein, the word "substantially," when applied to a characteristic of a composition or method of this disclosure, indicates that there may be variation in the characteristic without having an adverse effect on the chemical or physical attributes or functionality of the composition, device, or method.

As used herein, the term "about," when applied to the value for a parameter of a composition or method of this disclosure, indicates that the calculation or the measurement of the value allows some slight imprecision without having a substantial effect on the chemical or physical attributes of the composition or method. If, for some reason, the imprecision provided by "about" is not otherwise understood in the art with this ordinary meaning, then "about" as used herein indicates a possible variation of up to 3% in the value.

Further, the present disclosure contemplates that any particular feature or embodiment can be combined with any other feature or embodiment described herein.

The inventive technology pertains to an inflator system that is capable of rapid deployment of large volume airbag cushions, while generating fewer undesirable effluent species. Furthermore, in certain variations, the inventive technology provides an inflator system having improved reliability and faster airbag cushion deployment times. The inventive inflator systems may be used as part of inflatable restraint devices, such as airbag module assemblies, side impact inflators, seatbelt tensioners, hybrid inflators, and other similar applications. Inflatable restraint devices and systems have multiple applications within automotive vehicles, such as driver-side, passenger-side, side-impact, curtain, and carpet airbag assemblies. Other types of vehicles including, for example, boats, airplanes, and trains may also use inflatable restraints. In addition, other types of safety or protective devices may also employ various forms of inflatable restraint devices and systems. Inflatable restraint devices typically involve a series of reactions that facilitate production of gas in order to deploy an airbag or actuate a piston. In the case of airbags, for example, actuation of the airbag assembly system and ignition of the gas generant may inflate the airbag cushion within a few milliseconds.

Figure 1:
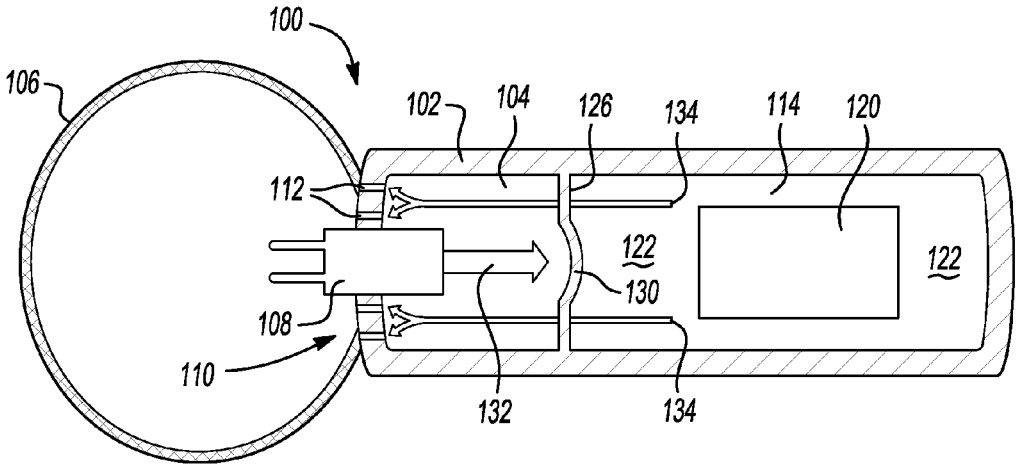
FIG. 1 is a simplified, partially sectional schematic drawing of an exemplary conventional prior art airbag inflator with a "reverse-flow" configuration.

By way of background, conventional so-called "reverse-flow" inflator configurations have been used to fill relatively large inflatable air bag curtains (e.g., approximately 45 L and larger). A simplified schematic of an exemplary reverse-flow inflator device is shown in FIG. 1. An inflator device 100 includes a housing 102 defining a first chamber 104. The inflator device 100 includes an initiator device 108 that is disposed at least in part within the first chamber 104. The inflator device 100 also has a first end 110 of housing 102 that has a plurality of apertures/openings or gas exit ports or openings 112. The plurality of exit ports or openings 112 are in fluid communication with the first chamber 104 and inflatable airbag cushion 106. Thus, inflation gas is dispensed from the first chamber 104 of the inflator device 100 into the associated inflatable airbag cushion 106. The housing 102 also defines a second chamber 114. The second chamber 114 contains one or more solid gas generants 120 (pyrotechnic material(s) that generate inflation gases by combustion). A "pyrotechnic" material, in its simplest form, comprises one or more oxidizing agents and one or more fuels that produce an exothermic, self-sustaining reaction when heated to the ignition temperature thereof. An inert fluid 122 may also be stored in the second chamber 114 in contact with the gas generant material 120.

The first chamber 104 and second chamber 114 are respectively sealed from one another by a temporary closure, such as an internal wall 126 comprising a burst or rupture disc 130. In operation, upon sensing of a collision, roll-over, or other trigger event, an electrical signal is sent to the initiator device 108. While not shown, typically an initiator or igniter device comprises a squib centrally disposed within a pyrotechnic initiator material that burns rapidly and exothermically. The squib in the initiator device 108 is capable of actuating or igniting the adjacent pyrotechnic initiator material (not shown, but contained within the initiator device 108) so as to generate heated gas (see arrow 132) to cause the burst disc 130 to rupture or burst. As a result, high temperature combustion products are discharged from the initiator device 108 into the first chamber 104 resulting in the heating and, in some cases, reaction of the contents contained therein. After the gases generated by the initiator device 108 rupture the burst disc 130, an opening is formed between the first and second chambers 104, 114 to permit fluid communication there between. At least a portion of the initiator contents concurrently pass through openings 112 into an associated airbag assembly 106 (which may include complex gas guidance systems), as well.

After the initiator gas 132 enters the second chamber 114, the gas generant material 120 is ignited and begins to combust, thus forming combustion gases (see arrows 134) that exit the second chamber 114 through the opening in internal wall 126 where the burst disc 130 was located and into the first chamber 104. The combustion gas 134 passes through exit openings 112 into the airbag cushion 106 to serve as an inflation gas.

Thus, the inflator device 100 has a configuration referred to as a reverse-flow inflator technology where the initiator device 108 and the plurality of gas exit openings 112 are located on the same side 110 of the housing 102 of the inflator device 100, as in FIG. 1. While this reverse-flow technology does provide a means to fill large inflatable curtains, such inflators typically do not have an ideal interface for attaching the inflator device to the curtain module (including airbag cushion 106). For example, a reverse flow inflator requires steel inflator gas guide hardware (not shown in FIG. 1), which increases complexity, cost, and weight of the system. There are a significant number of commercial systems that currently employ much larger, more expensive, and thus less desirable reverse-flow inflator device technology.

Instead, a more desired interface for connecting inflators to side and curtain restraint modules can be provided by a blow-down inflator device configuration. In certain variations, an inflator system for an airbag according to the present teachings has a so-called "blow-down" configuration, as will be described in more detail below. In an exemplary simplified blow-down inflator device 150 shown in FIG. 2, a plurality of gas exit ports or openings 152 is located at a first end 154 of a housing 156 of the inflator device 150. An initiator 160 and its electrical connection are disposed at a second end 164 of the housing 156 opposite to the first end 154. This arrangement makes possible the complete elimination of expensive and cumbersome steel inflator gas guide hardware in favor of a lightweight and less expensive textile material for guiding inflation gas to the air bag cushion (not shown in FIG. 2). Thus, the use of blow-down inflator technology to fill one or more inflatable curtains provides reduced system cost and complexity.

Figure 2:
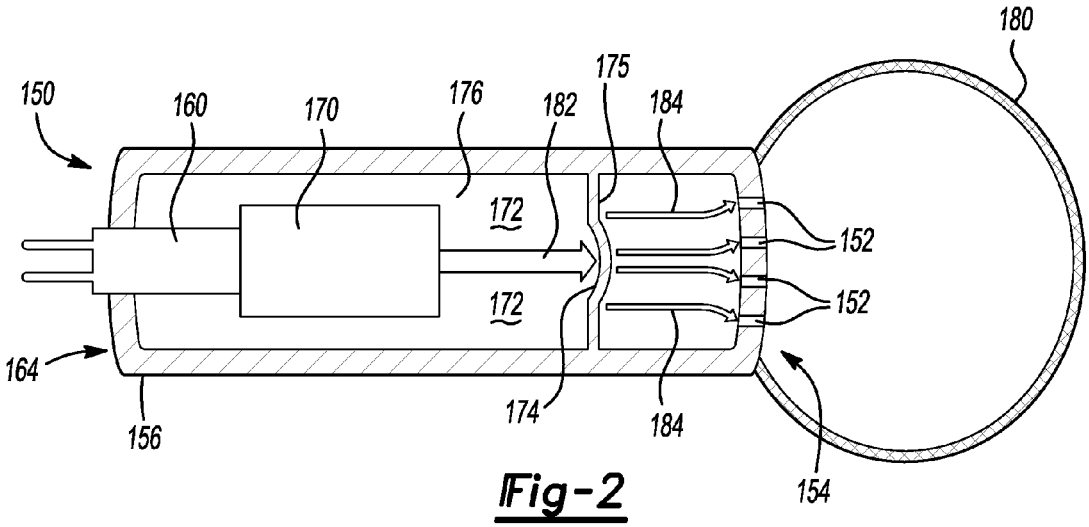
FIG. 2 is a simplified, partially sectional schematic drawing of an exemplary conventional prior art airbag inflator with a "blow-down" configuration.

However, in the past, conventional blow-down inflator technologies have failed to demonstrate the capability of filling relatively large airbag curtains (e.g., 45 L and larger). One major reason that such blow-down inflators have previously failed to provide a solution for large volume airbags is due to extremely rapid deployment requirements for large volume airbags, like inflatable curtains. Blow-down inflators rely on energy from an initiator device 160 (with a pyrotechnic initiator material) and any internally disposed gas generant 170 to be conveyed through the stored inflation media 172 (see arrow indicating gas stream 182) to actuate a rupture or burst disc 174 (as shown in FIG. 2 disposed in internal wall 175). The inflation media 172 is stored in a gas storage chamber 176 as it is generated by the initiator 160, gas generant pyrotechnic materials 170, and the like until it reaches a predetermined pressure, where the burst disc 174 is ruptured and opens. After the burst disc 174 is ruptured, combustion gas (shown by arrows 184) flows from the storage chamber 176 through the plurality of openings 152 into the curtain 180. Relying upon over-pressurization in the gas storage chamber 176 by flow and build-up of combustion gases therein (see arrow 182) to actuate and rupture the burst disc 174 amounts to an inflator device 150 that is either too slow to meet curtain in-position requirements (e.g., for large curtain airbags), or in cases where timing is sufficient, internal pressures generated within the gas storage chamber vessel 176 are excessive. Excessive pressure can potentially be detrimental to the structure of the airbag itself, to the automobile instrument panel, and to the occupants as it may have the potential to cause out-of-position injuries. Excessive pressure can also require use of much heavier materials and more substantial inflator device componentry to safely contain such high pressures.

In accordance with the inventive technology; however, a new inflator device can have a blow-down inflator device configuration that can meet required timing constraints without producing excessive and undesirable internal pressure. In various aspects, the present technology provides increased performance to fill a relatively large airbag curtain, which as used herein refers to an airbag curtain having a fill volume of greater than or equal to about 45 liters (L), optionally greater than or equal to about 50 L, optionally greater than or equal to about 55 L, in certain preferred aspects, optionally greater than or equal to about 60 L. Airbag curtains having a volume larger than 60 L are also contemplated, as future governmental mandates that all vehicles meet ejection mitigation requirements will increase the need for airbag curtains larger than 60 L. Thus, in certain variations, the present technology further contemplates an airbag curtain having a fill volume of optionally greater than or equal to about 65 L or optionally greater than or equal to about 70 L, optionally greater than or equal to about 75 L, by way of non-limiting example. The present technology is demonstrated to be capable of effectively filling airbag curtains having a fill volume of greater than or equal to 100 liters.

In certain variations, the inflator devices of the present disclosure can meet required timing constraints for substantially inflating a large volume airbag, for example, an airbag curtain having a fill volume of greater than or equal to about 60 liters, which is substantially inflated in less than or equal to about 25 milliseconds after the initiator device is actuated, by way of example.

Figure 3:
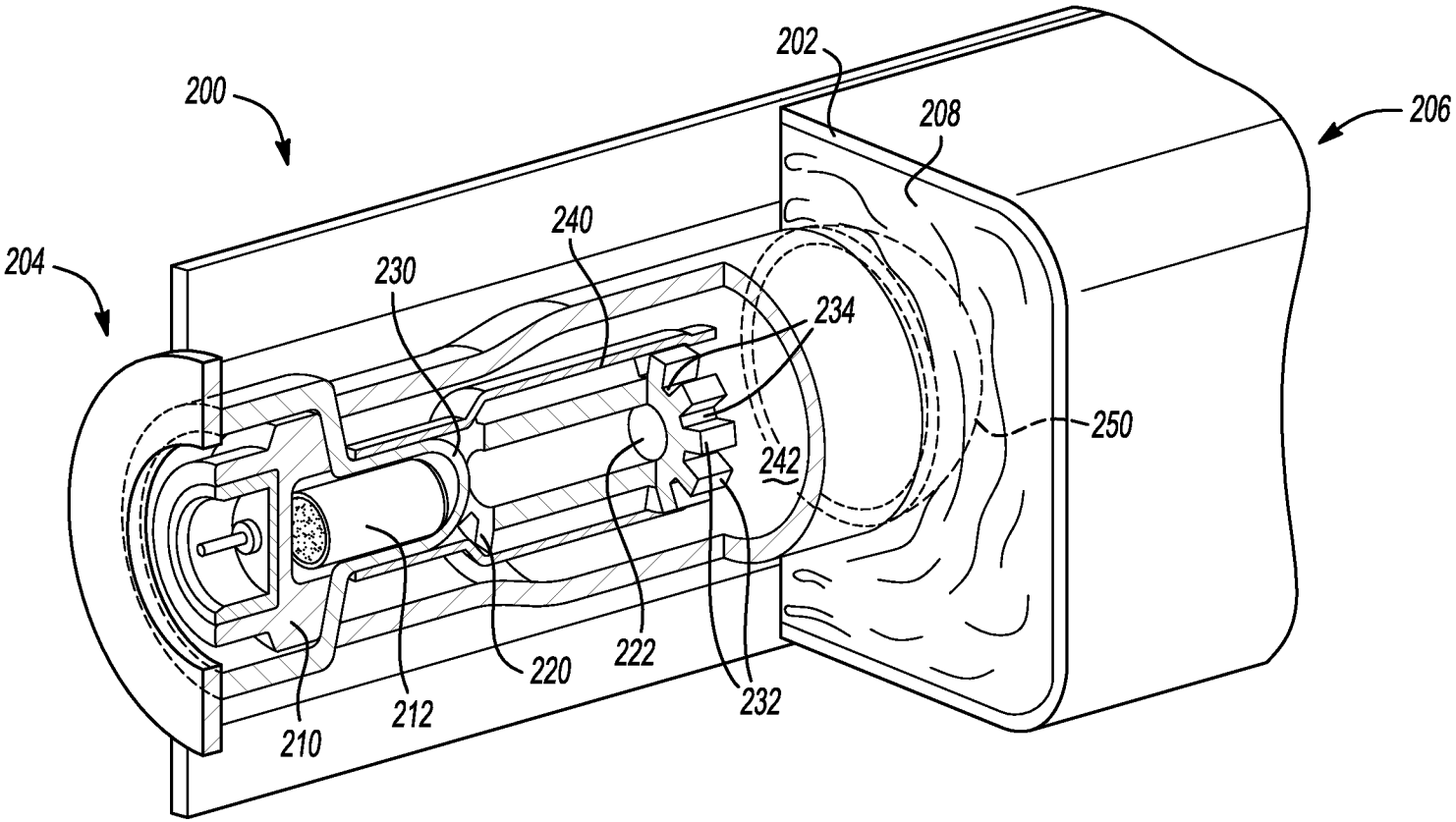
FIG. 3 is a partially cut-away illustration of an inflator device according to various aspects of the present disclosure.
Figure 4:
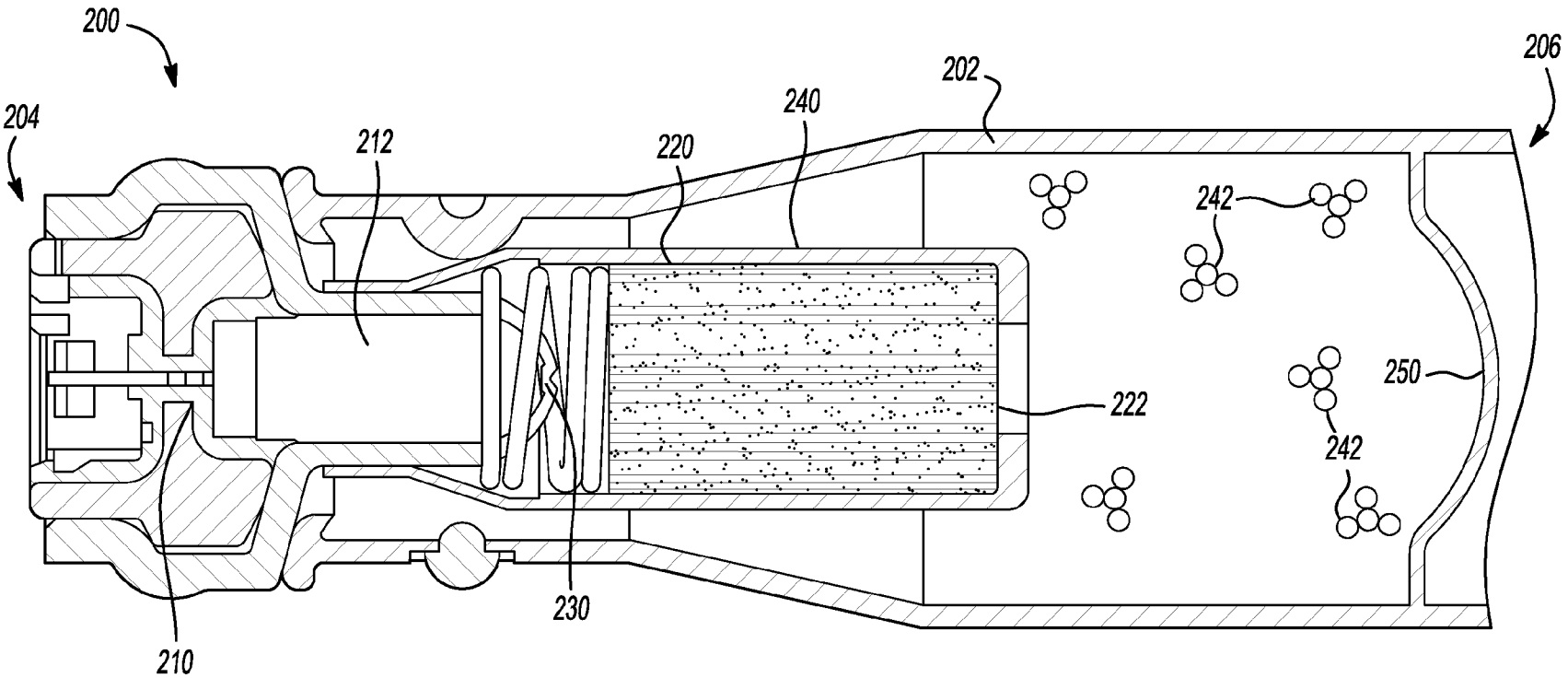
FIG. 4 is a detailed sectional view of the inflator of FIG. 3.

Therefore, in various aspects, the present disclosure provides an inflator device for an airbag curtain, particularly on that is a large volume airbag curtain. With reference to FIGS. 3 and 4, an inflator device 200 in accordance with the inventive technology employs a shock wave opening of a temporary closure (e.g., a burst disc 250) between the inflator and the airbag, while having the capability to meet required timing constraints, without producing excessive and undesirable internal pressure for airbags having relatively large fill volumes. The inflator device 200 includes a housing 202 that defines a first end 204 and a second opposite end 206. The housing 202 includes an initiator device 210 comprising an igniter or initiator pyrotechnic material 212. The housing 202 also includes a monolithic fuel-rich gas generant grain 220 that combusts to produce an inflation gas to inflate a downstream airbag curtain 208. The initiator device 210 is located near the first end 204 of the housing 202, while the airbag curtain 208 is located near the second end 206. The gas generant grain 220 is preferably in actuating proximity to the initiator device 210 to initiate combustion of the gas generant pyrotechnic material in the gas generant grain 220. For example, the gas generant grain 220 as shown in FIG. 3 is downstream from and adjacent to the initiator device 210. The initiator device 210 and the gas generant grain 220 may be separated from one another by a temporary separator 230, such as a burst or rupture disc. The gas generant grain 220 defines at least one through-channel 222 that permits the flow of a shock wave or gas flow through the solid body of the monolithic grain 220. As shown, the gas generant grain 220 has a plurality of radial fins 232, which also define a plurality of grooves 234 therebetween, which can form flow channels, as well.

Further, in certain preferred aspects, the gas generant grain 220 comprises a pyrotechnic material that is fuel-rich, as will be discussed in greater detail below. In certain embodiments, the gas generant grain 220 may be partially or wholly disposed within a storage chamber 240 in the housing 202. The storage chamber 240 stores a compressed or pressurized gas storage media 242, which comprises at least one gaseous oxidizer or oxidant that is capable of reacting with the fuel-rich gas generant grain 220. In certain embodiments, the fuel-rich gas generant grain 220 is at least partially disposed within the storage chamber 240 that stores the pressurized gas 242. In the embodiment shown in FIGS. 3 and 4, the fuel-rich gas generant grain 220 is entirely contained by and disposed within the storage chamber 240 that stores the pressurized gas 242.

In other alternative variations, the fuel-rich gas generant grain 220 can be disposed in a distinct pyrotechnic chamber (not shown). In such alternative embodiments, a downstream mixing chamber (also not shown) can be located between the distinct pyrotechnic chamber and the stored gas chamber to provide a location for combustion and mixing of the pressurized gas 242 with combustion products from the gas generant grain 220. In such variations, a temporary closure can be employed between the pyrotechnic and mixing chambers. However, in certain preferred aspects, the monolithic gas generant grain 220 is in fluid communication with stored pressurized gas 242 prior to actuation and deployment. Thus, in certain embodiments like that shown in FIG. 3, the monolithic grain 220 is disposed either partially or wholly within the storage chamber 240 comprising pressurized gas 242, so that the monolithic gas generant grain 220 is in fluid communication with the pressurized gas 242. Fluid communication between the storage chamber 240 and a downstream airbag 208 is restricted by the presence of a second temporary closure 250 (e.g., a burst or rupture disc).

During initiation and operation of the inflator device 200, preferably at least a portion of the fuel-rich gas generant grain 220 is in contact with the pressurized gas 242 in the storage chamber 240, so that a reaction may occur between an oxidant contained in the pressurized stored gas and the pyrotechnic gas generant material forming the gas generant grain 220, which includes reaction of the oxidant with typically gaseous products generated by the gas generant material as it begins to combust. In certain embodiments, at least a portion of the gas generant grain is disposed within the storage chamber containing the pressurized gas 242. While not shown, in alternative embodiments, the fuel-rich gas generant grain 220 may be separated from the storage chamber 240 by a third temporary closure, like a burst disc (not shown). The storage chamber 240 is in fluid communication with the airbag curtain 208 (shown in a stowed and folded state) at the second side 206 of the housing 202. As discussed above, the housing 202 may include the second temporary closure 250 for temporarily sealing and preventing fluid communication between the storage chamber 240 and the downstream airbag curtain 208, until inflation of the airbag 208 is required.

In operation, the initiator device 210 receives an electrical signal or other trigger that initiates reaction (often by a squib, not shown) of the ignition pyrotechnic material 212 contained within initiator device 210. In certain preferred aspects, the initiator device 210 is capable of generating a shock wave of heated gas that can rupture any barrier (e.g., temporary closure burst disc 230) between the initiator device 210 and the gas generant grain 220. As used herein, a "shock wave" refers to the propagation of pressure waves through the stored gas at a speed greater than the local speed of sound. Once the shock wave enters the gas generant grain 220, it propagates through the one or more flow channels 222 or 234 defined in the solid grain 220. The shock wave may rupture a temporary closure (not shown in the embodiments of FIGS. 3 and 4) between the fuel-rich gas generant grain 220 and the storage chamber 240. Importantly, the shock wave facilitates opening of the second temporary closure or burst disk 250 between the storage chamber 240 and the downstream airbag 208. Thus, combustion gas and/or pressurized gas storage media 242 is permitted to enter the airbag curtain 208, so that it can be rapidly inflated (see gas flow indicated by arrows 184 through openings 152).

Accordingly, the present disclosure optionally provides an inflator system, such as described above, where an initiator device and electrical connection are both disposed at a first end of a gas storage vessel, while one or more gas exit locations are disposed at a second end, opposite to the first end of the gas storage vessel, in other words a so-called "blow-down" inflator configuration. Such an inflator system provides the ability to use an inflator device of the present teachings to fill previously unattainable large curtain volumes within relatively short time windows. It should be noted that while the discussion of the inventive technology above pertains to a blow-down inflator configuration, the present teachings are not exclusively limited to such blow-down inflator configurations, but are also generally applicable to reverse-flow or other inflator systems.

The pressurized inflation media/stored gas (e.g., 242) contained in gas storage chamber (e.g., 240) comprises at least one oxidizer. In certain preferred variations, the pressurized stored gas has an average molecular weight of greater than or equal to about 20 g/mol to less than or equal to about 40 g/mol. Although not limiting the present teachings, in certain embodiments, the pressurized gas (e.g., 242) contained in the gas storage chamber (e.g., 240) has a pressure of greater than or equal to about 7,000 to less than or equal to about 10,500 pounds per square inch absolute (psia) (greater than or equal to about 48 MPa to less than or equal to about 72 MPa).

At least one component of the stored gas media (e.g., 242) comprises an oxidant or oxidizer in a gaseous form. The oxidizer present in the pressurized storage gas media is capable of reacting with fuel components in the fuel-rich gas generant, which also includes the capability of reacting with combustion products from the fuel-rich gas generant, such as partially oxidized species. Suitable oxidants in a gaseous form for the pressurized gas mixture include oxygen ($O_2$), nitrous oxide ($N_2O$), and combinations thereof, by way of non-limiting example. A plurality of oxidizers may also be employed. In certain embodiments, oxygen ($O_2$) is a preferred oxidant for the pressurized gas mixture.

In various aspects, a stored gas media according to the present teachings may comprise a plurality of components in addition to the oxidizer(s). For example, one particularly suitable stored gas media may comprise an oxidizer, such as oxygen, as well as inert gas components. Suitable inert gases include helium and argon, by way of non-limiting example.

The amount of gaseous oxidizer present in the pressurized gas may vary depending upon the stoichiometric ratio of fuel to oxidizer present in the gas generant, as appreciated by those of skill in the art. As discussed below, in various aspects, the gas generant pyrotechnic material is a fuel-rich gas generant composition having an excess of fuel in relation to the combustion reaction stoichiometry. While a wide range of oxidant concentrations may be employed in conjunction with the present teachings, preferably enough oxidant is present in the pressurized storage media gas to combust any partially oxidized species (for example, $H_2$ or otherwise undesirable species found in the effluent, like carbon monoxide (CO)) created by the gas generant before encountering and reacting with the oxidant in the pressurized gas. Preferably, the overall fuel to oxidant ratio, when considering a total amount of oxidants (including the pressurized gas oxidant(s)) and the amount of fuel in the gas generant should be within a range of combustibility. In certain aspects, an overall fuel to oxidant ratio provided in the system (including all fuel and oxidants in the gas generant material and pressurized storage gas) should provide an approximately stoichiometric final mixture to ensure complete or near complete conversion of all fuel species.

In certain aspects, it may be advantageous for an amount of oxidant present in the stored pressurized gas to be present at a level greater than an amount necessary to ensure complete conversion of all fuel species in the gas generant material due to the fact that stored pressurized gas media is exiting the inflator device (and filling the airbag) concurrent to the decomposition of the fuel-rich gas generant grain. In other words, in certain aspects, an amount of oxidant present in the stored pressurized gas media is selected to be sufficient to ensure complete conversion of fuel species at the point when the fuel-rich generant grain is completing the decomposition reaction (rather than only considering an amount present at the beginning of the decomposition process). Thus, in certain variations, which will be described in greater detail below, the oxidizer is optionally present in the stored gas media at a concentration of greater than or equal to about 1 mole % to less than or equal to about 22 mole % of the gas. In certain embodiments, the oxidizer in optionally present in the stored gas media at a concentration of greater than or equal to about 5 mole %; optionally greater than or equal to about 10 mole %; optionally greater than or equal to about 15 mole %; optionally greater than or equal to about 18 mole %; optionally greater than or equal to about 19 mole % to less than or equal to about 21 mole % by volume of the gas; and in certain aspects, equal to about 20 mole % by volume of the stored gas media.

In various aspects, a molecular weight of the pressurized stored gas media is preferably greater than or equal to about 20 g/mol to less than or equal to about 40 g/mol. A pressurized gas having a molecular weight of less than about 20 g/mol has potential to leak from the airbag cushion faster, so that a standup time of the curtain taken at 5 seconds is negatively impacted by a relatively low molecular weight of the stored pressurized gas, while pressurized gases having heavier weights (more than about 40 g/mol) can potentially be too slow to adequately deploy the airbag cushion. Also, a high gas mass for example, having a molecular weight in excess of 40 g/mol, potentially results in a high mass flow that can exert increased damage to the airbag cushion. Further, a relatively high average molecular weight of a gas can undesirably increase the inflator weight in a vehicle. Thus, in certain variations, the pressurized stored gas media has a molecular weight of greater than or equal to about 25 g/mol to less than or equal to about 35 g/mol; optionally greater than or equal to about 26 g/mol to less than or equal to about 34 g/mol; optionally greater than or equal to about 27 g/mol to less than or equal to about 33 g/mol; optionally greater than or equal to about 28 g/mol to less than or equal to about 32 g/mol; and optionally greater than or equal to about 29 g/mol to less than or equal to about 32 g/mol. In certain particularly preferred variations, a pressurized stored gas media according to the present technology has an average molecular weight of about 30 g/mol to about 32 g/mol, optionally about 31 g/mol in certain variations. A gas having such a range of molecular weights provides good performance in an airbag inflator.

In certain preferred aspects, a stored pressurized gas may comprise oxygen gas ($O_2$) as an oxidant, as well as helium (He) and argon (Ar). For example, in certain embodiments, the pressurized gas comprises a mixture of about 10 to about 20 mole % oxygen, about 20 mole % helium, and about 60 mole % to about 70 mole % argon. By way of example, one particularly suitable stored pressurized gas media may comprise a mixture of about 20 mole oxygen, about 20 mole % helium, and about 60 mole % argon. Other alternative embodiments of suitable pressurized gas media mixture comprise about 15% by volume oxygen, about 20 mole % by volume helium, and about 65 mole % by volume argon or about 10% by volume oxygen, about 20% by volume helium, and about 70% by volume argon.

In certain variations, the pressurized gas consists essentially of oxygen, argon, and helium. For example, in certain embodiments, the pressurized gas consists essentially of a mixture of about 10 to about 20% by volume oxygen, about 20% by volume helium, and about 60% to about 70% by volume argon. One particularly suitable example of a pressurized gas consists essentially of a mixture of about 20% by volume oxygen, about 20% by volume helium, and about 60% by volume argon. An average molecular weight of this stored pressurized gas is approximately 31.2 g/mol.

The presence of helium in the pressurized gas storage medium allows for leak testing of the pressurized gas chamber. Because argon is inert and a large atom, it is less susceptible to leakage through any potential holes in the joints and welds of the inflator device housing and therefore is provided at higher quantities in the mixture. For example, in certain variations, a volume of an oxidant (e.g., $O_2$) present in the pressurized gas is present at greater than or equal to about 1 to less than or equal to about 20% by volume of the total pressurized gas volume, which provides a safe concentration of oxygen, while optimizing performance and providing an adequate amount of oxidant to react with fuel and partially oxidized reaction products (e.g., generated by the initiator and gas generant). Oxygen as an oxidant at 20% by volume is particularly preferred in this regard. As noted above, a desirable gas mixture has an average molecular weight of about 31 g/mol, which is similar to the inert gas mixture of 75% argon and 25% helium that is frequently used as a storage media in conventional inflator device systems. Thus, the speed of gas deployment and mass flow rates are quite similar to those of a conventional mixture of argon and helium gas, so that existing hardware systems may be used. Further, a compressibility factor (Pressure/Volume/Temperature) relationship is also similar to the conventional argon/helium mixture, so existing fill pressures and thus existing burst disc hardware can be employed.

Because existing fill pressure and mass flow rates of the above-described pressurized gas mixtures comprising at least one oxidant are similar to the conventional argon/helium fill gas mixture, potential energy at the cushion at deployment is similar, so existing or larger volume airbag cushions can be used. This is especially the case with a pressurized gas mixture of about 20% by volume oxygen, about 20% by volume helium, and about 60% by volume argon. In certain aspects, such a gas mixture, when used in accordance with a monolithic fuel-rich gas generant in accordance with certain aspects of the present teachings can provide a performance increase of about 35-40%, while being able to use existing hardware (e.g., diffuser gas flow control orifices, burst discs, etc.).

Although not limiting the present teachings, in certain embodiments, the pressurized gas 242 contained in the storage chamber 240 has a pressure of greater than or equal to about 7,000 to less than or equal to about 10,500 pounds per square inch atmospheric (psia) (greater than or equal to about 48 MPa to less than or equal to about 72 MPa). Such a range of pressures for storing pressurized gas allows for rapid airbag filling, which is particularly important for side-impact curtain designs. Further, this pressure range is similar to those of conventional inert gas mixtures, so that existing fill machines and equipment can be used. Further, pressures above 10,500 psia can potentially be harder to fill, require thicker walled housing, result in heavier designs, and may veer into undesirable gas liquefaction, which can be somewhat unpredictable. However, it should be noted that in certain alternative variations, the present disclosure contemplates employing such higher pressures as improvements to strength of the gas storage chamber construction and design are realized. In certain variations, the pressurized gas 242 contained in the gas storage chamber has a pressure of greater than or equal to about 7,000 psia (48 MPa) to less than or equal to about 8,000 psia (55 MPa). In other variations, a suitable pressurized gas pressure is greater than or equal to about 9,000 psia (62 MPa), optionally greater than or equal to about 10,000 psia (69 MPa).

In accordance with the present teachings, the gas storage vessel further comprises a monolithic gas generant grain, like a fuel-rich gas generant grain, which is in actuating proximity to the initiator device. In various aspects, the gas generant grain provides a path for a shock wave, produced by the initiator device, to travel through the grain and actuate a feature capable of rupturing, such as a burst disc. In various aspects, a fuel-rich grain used in accordance with the present teachings comprises a gas generant material that comprises a mixture of components that is non-stoichiometric with respect to fuel and oxidizer.

Combustion of the gas generant material can occur in lean, rich, or stoichiometric conditions. A stoichiometric reaction is defined as one in which all the reactants (oxidants and fuels) are consumed and converted to products in their most stable and oxidized form. The designation "lean" refers to fuel components being present in a sub-stoichiometric amount to one or more oxidizers in the gas generant material, while the designation "rich" refers to fuel components being present in an excess or super-stoichiometric amount to one or more oxidizers in the gas generant material. In various aspects, a gas generant grain, such as a monolithic gas generant grain, used in accordance with the present teachings has a fuel-rich or rich stoichiometry, so that substantially more fuel components are chemically stored within the gas generant pyrotechnic material than oxidizer components in relation to the combustion stoichiometry.

"Equivalence ratio" or $\phi$ is an expression commonly used in reference to combustion and combustion-related processes. Equivalence ratio is defined as a ratio of an actual amount of fuel components (F) to an actual amount of oxidant components (O) present in a material, expressed by $(F/O)_A$ divided by a ratio of a stoichiometric amount of fuel to stoichiometric amount of oxidant expressed by $(F/O)_S$. For example, one way to determine equivalence ratio is by Equation I:

$$EQ = \frac{\left(\frac{n_f}{n_o}\right)_{actual}}{\left(\frac{n_f}{n_o}\right)_{stoichiometric}} \quad \text{(I)}$$

where $n_f$ is moles of the fuel and $n_o$ is moles of the oxidant.

Thus, a stoichiometric amount of fuel(s) to oxidant(s) equates to an equivalence ratio of 1. A sub-stoichiometric amount of fuel(s) to oxidant(s) equates to an equivalence ratio of less than 1. The designation "rich" refers to fuel component(s) being present in a gas generant at a greater than stoichiometric amount to oxidant component(s) for a combustion reaction, which equates to an equivalence ratio of greater than 1. In accordance with the present teachings, the pyrotechnic gas generant material is a fuel-rich gas generant composition having an equivalence ratio of greater than 1. In certain variations, the fuel-rich monolithic gas generant grain has an equivalence ratio of greater than or equal to about 1.1; optionally greater than or equal to about 1.2; optionally greater optionally greater than or equal to about 1.3; optionally greater than or equal to about 1.4; optionally greater than or equal to about 1.5; optionally greater than or equal to about 1.6; optionally greater than or equal to about 1.7; optionally greater than or equal to about 1.8; optionally greater than or equal to about 1.8; optionally greater than or equal to about 1.9; and in certain variations, optionally greater than or equal to about 2.

In certain variations, the monolithic gas generant grain comprises a gas generant composition that has an equivalence ratio of greater than or equal to about 1.1 and less than or equal to about 2; optionally greater than or equal to about 1.33 and less than or equal to about 1.8.

In various aspects, there is a sufficient amount of chemically-stored oxidizer component(s) in the gas generant material forming the fuel-rich monolithic gas generant grain to facilitate combustion; however, additional oxidizer required to achieve complete decomposition of the fuel component (or partial combustion byproducts) present in the gas generant mixture is instead provided by the one or more oxidizer components present in the stored pressurized gas media. In this regard, a stored compressed gas media mixture of the inventive technology can serve dual purposes of immediately filling the air bag cushion with gas inflation media, thereby providing rapid occupant protection, and secondly, completing decomposing reaction products and fully combusting the fuel-rich monolithic gas generant grain product species.

The ballistic properties of a gas generant are typically controlled by the gas generant material composition, shape and surface area of the gas generant grain, as well as the burn rate of the material. Various aspects of the present disclosure provide a gas generant having a monolithic grain shape tailored to create rapid heated gas. The grain shape has a desired surface area and shape to facilitate prolonged reaction and to create preferred gas production profiles at the desired pressures, as will be described in more detail below. In certain variations, the gas generant material is substantially free of binder, thus further enabling development of desirable burn and pressure profiles. It is the combination of the selected gas generant material composition, initial surface area, shape, and density of the monolithic gas generant grain that maximizes the desired performance results, which can be further facilitated by the removal of binder that might potentially otherwise impede rapid reaction.

In certain variations, a monolithic gas generant grain for use in the present inflator devices comprises a gas generant powder material that is compressed to form a monolithic grain shape having an actual density that is greater than or equal to about 90% of the maximum theoretical density. According to certain aspects of the present disclosure, the actual density is greater than or equal to about 95%, more preferably greater than about 97% of the maximum theoretical density, and even more preferably greater than about 98% of the maximum theoretical density. Such high actual mass densities in gas generant materials are obtained where high compressive force is applied to gas generant raw materials that are substantially free of binder.

For example, gas generant materials may be in a dry powderized and/or pulverized form and are compressed in a mold or die with applied forces greater than about 50,000 psi (approximately 350 MPa), preferably greater than about 60,000 psi (approximately 400 MPa), more preferably greater than about 65,000 psi (approximately 450 MPa), and most preferably greater than about 74,000 psi (approximately 500 MPa) to form a desired grain shape. Such a high actual density as compared to the theoretical mass density provides the ability of the gas generant grain to hold its shape during combustion (rather than fracturing and/or pulverizing), which assists in maintaining the desirable performance characteristics, such as progressive surface area exposure, burn profile, combustion pressure, and the like.

Further, it is preferred that a loading density of the gas generant is relatively high; otherwise a low performance for a given envelope may result. A loading density is an actual volume of generant material divided by the total volume available for the shape. In accordance with various aspects of the present disclosure, it is preferred that a loading density for the gas generant is greater than or equal to about 60%, even more preferably greater than or equal to about 62%. In certain aspects, a gas generant has loading density of about 62 to about 63%.

In accordance with various aspects of the present disclosure, a monolithic gas generant grain is created via certain processing steps to have a specific shape that enables such desirable properties. In certain embodiments, the gas generant is in the form of a single large monolithic grain. The desired shape of the monolithic grain is linked to ballistic characteristics of the composition. The shape of the monolithic grain augments and controls the burn rate of the gas generant composition. The rate of generation of gas from a gas generant can be expressed by the following equation: $m_g=\rho_g A_b yr$ where "$m_g$" is a gas generation rate (mass per unit time), "$\rho_g$" density of the gas generant, "$A_b$"=burning area of the surface, "y" is a multiplication factor defined as the generant gas yield and "r" is the mass burning rate, also known as the surface recession rate (length per unit time). The burning rate is an empirically determined function of the gas generant grain composition, and depends upon various factors including initial temperature of the gas generant, combustion pressure, velocity of gaseous combustion products over the surface of the solid, and the gas generant grain shape. A linear burn rate "$r_L$" for a gas generant material is independent of the surface of the gas generant grain shape and is also expressed in length per time at a given pressure. In various embodiments, a desirably high burning rate enables not only sufficiently rapid combustion gas generation, but also desirable pressure curves for inflation of the airbag.

In accordance with various aspects of the present disclosure, the gas generant has a linear burn rate of greater than or equal to about 0.75 inches per second at a pressure of about 3,000 pounds per square inch (psi) (approximately 21 MPa). A burn rate of a material is typically related to inflator operating pressures, as well as to the design of the gas generant grain. In certain embodiments, the burn rate for the gas generant is greater than or equal to about 1 inch per second at a pressure of about 3,000 psi (about 21 MPa). In certain preferred variations, the linear burn rate of the gas generant is greater than or equal to about 1.1 inches per second, optionally greater than or equal to about 1.2 inches per second at a pressure of about 3,000 psi (21 MPa).

Further, in accordance with certain embodiments, the gas yield of the gas generant is relatively high. For example, in certain embodiments, the gas yield is greater than or equal to about 2.4 moles/100 grams of gas generant. In other embodiments, the gas yield is greater than or equal to about 2.5 moles/100 g of gas generant. Expressed in another way, the amount of gas produced for a given mass of gas generant present at a specific volume is relatively high. Generally, maximizing the gas product of gas generant mass by volume provides better gas generant performance for airbag inflation.

In this regard, the product of gas yield and density can be an important parameter for predicting performance of the gas generant. A product of gas yield and density (of the gas generant) is preferably greater than about 5.0 moles/100 $cm^3$, and even more preferably greater than about 5.2 moles/100 $cm^3$, in various embodiments. In accordance with various embodiments of the present disclosure, a flame temperature during combustion may optionally range from about 1400 K to about 2300 K. Generally, a higher flame temperature can be desirable for performance because it heats the gas mixture more effectively.

Figure 5:
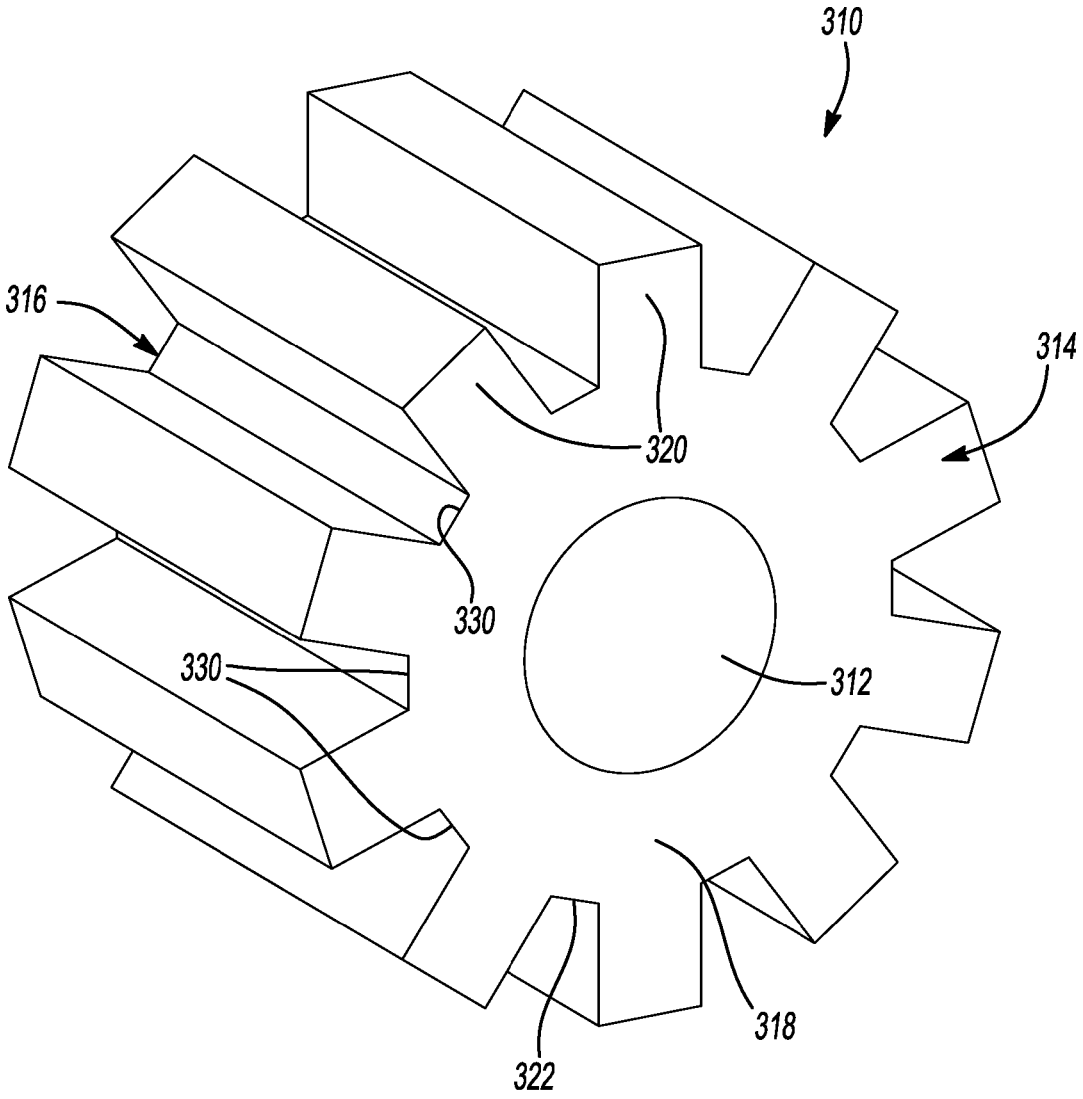
FIG. 5 is an isometric view of a pressed monolithic gas generant suitable for use with inflators in certain embodiments of the present disclosure.

For purposes of illustration, FIG. 5 depicts a single pressed monolithic gas generant grain shape 310 that is exemplary of the type of gas generant grain that can be employed with the present teachings. Such a gas generant shape is likewise shown in the inflator device 200 of FIGS. 3 and 4 (see gas generant grain 220). The monolithic gas generant grain shape 310 like that shown in FIG. 5 is distinct from that of a conventional pellet (cylindrical shape) or wafer (a toroidal ring shape). The monolithic gas generant grain 310 has a "star-like" shape. At least one central aperture 312 extends from a first side 314 to a second side 316 of a body 318 the gas generant grain 310. Aperture 312 thus forms a through-hole or flow channel to provide fluid communication from the first side 314 to the second side 316 of the gas generant grain 310. The monolithic gas generant grain 310 also has a plurality of protruding radial fins 320 extending radially outward from an outer surface 322 of the body portion 318 of the gas generant grain 310. A plurality of grooves 330 are formed between the radial fins 320. Gases may also flow through these grooves or channels 330 (see also, grooves/channels 232 in FIG. 3, where gases formed by the initiator 212 can flow).

A gas generant grain 310 like that in FIG. 5 is merely exemplary; different configurations, dimensions, and quantities of the apertures 312, fins 320, and grooves 330 for forming flow channels in the gas generant grain 310 are contemplated, so long as a sufficient amount of initiator shock wave/heated gases are rapidly transmitted through the body 318 of the gas generant grain 310 to enable rapid inflation of an airbag cushion in accordance with the present teachings. In certain aspects, the ability of the monolithic gas generant grain to propagate a shock wave is an important aspect of the inventive technology so as to provide rapid enough inflation for an airbag cushion. For example, the apertures/channels 312, 330 should not be too long or too small in diameter so as to restrict a sufficient volume of gas from traveling through the body 318 of the gas generant grain 310, as appreciated by those of skill in the art.

In certain variations of the present teachings, the ballistic properties of suitable monolithic gas generant grain designs for use in accordance with certain aspects of the present teachings generate a mass flow that is fairly neutral. Such characteristics help reduce undesirable effluent products and provide better control over combustion pressure.

The gas generant material composition comprises a pyrotechnic component selected from the group consisting of: fuels, oxidizing agents, auto-ignition materials, binders, slag forming agents, coolants, flow aids, viscosity modifiers, dispersing aids, phlegmatizing agents, excipients, burning rate modifying agents, and mixtures and combinations thereof. It is understood that while general attributes of each of the categories of pyrotechnic components described herein may differ, there may be some common attributes and any given material may serve multiple purposes within two or more of such categories of pyrotechnic active components. Thus, classification or discussion of a material within this disclosure as having a particular utility is made for convenience, and no inference should be drawn that the material must necessarily or solely function in accordance with its classification herein when it is used in any given composition. Such pyrotechnic components typically function to improve the functionality and/or stability of the pyrotechnic material during storage; modify the burn rate or burning profile of the gas generant composition; improve the handling or other material characteristics of the slag which remains after combustion of the gas generant material; and improve ability to handle or process pyrotechnic raw materials. It should be noted that the disclosure contemplates any variety of pyrotechnic compositions known or to be developed in the art and is not limited to any particular examples set forth below. The following discussion of pyrotechnic components is not exhaustive, but rather illustrative of preferred examples.

Conventional gas generant materials comprise at least one fuel. Many different pyrotechnic fuel materials can be used in gas generant formations. A non-limiting list of typical pyrotechnic fuels suitable for use in the gas generant pyrotechnic compositions, include: boron, zirconium, titanium hydride, silicon, guanidine derivatives, tetrazoles, bitetrazoles, guanylurea derivatives, copper complexes and guanylurea derivatives, cyclotrimethylenetrinitramine (RDX), octahydro-1,3,5,7-tetranitro-1,3,5,7-tetrazocane (HMX), and other nitrogen-containing compounds. Additional examples of fuel components include: tetrazole salts, such as aminotetrazole and mineral salts of tetrazole; 1,2,4-triazole-5-one; guanidine nitrate; nitro guanidine; amino guanidine nitrate; metal nitrates; and the like. These fuels may be categorized as gas generant fuels due to their relatively low burn rates and are often combined with one or more oxidizers in order to achieve desired burn rates and gas production.

In certain embodiments, the fuel component may be a non-azide nitrogen-containing fuel compound, such as an organic fuel, including one or more of guanidine nitrate, nitroguanidine, aminoguanidine nitrate, diaminoguanidine nitrate, triaminoguanidine nitrate, guanylurea nitrate, tetrazoles, bitetrazaoles, azodicarbonamide and mixtures thereof. Particular non-azide nitrogen-containing fuel compounds include guanidine nitrate and hexamine cobalt III nitrate. Use of guanidine nitrate in gas generant compositions is generally based on a combination of factors relating to cost, thermal stability, availability, and compatibility with other composition components. Such fuels are generally categorized as gas generant fuels due to their relatively low burn rates.

In certain aspects, gas generant compositions having suitable burn rates, density, and gas yield for inclusion in the pyrotechnic gas generant materials of the present disclosure include those described in U.S. Pat. No. 6,958,101 to Mendenhall et al., the disclosure of which is herein incorporated by reference in its entirety. U.S. Pat. No. 6,958,101 discloses suitable fuels for the pyrotechnic materials of the present disclosure, which comprise non-azide compounds having a substituted basic metal nitrate. Substituted basic metal nitrate reaction products formed include 5-amino tetrazole substituted basic copper nitrate, bitetrazole dihydrate substituted basic copper nitrate, nitroimidazole substituted basic copper nitrates, which are all suitable fuels for use in the pyrotechnic materials of the disclosure.

In certain preferred aspects, gas generant pyrotechnic fuels found to exhibit such desired properties for a fuel-rich a fuel such as guanylurea nitrate, melamine, cyanuric acid, nitroguanidine, nitrotriazolone, barbituric acid, nitrobarbituric acid, salts of nitrobarbituric acid, aminoguanidine and salts thereof, diamminoguanidine and salts thereof, combinations and equivalents thereof.

As appreciated by those of skill in the art, such fuel compositions may be combined with additional components in the gas generant, such as co-fuels. For example, in certain embodiments, a gas generant composition comprises a substituted basic metal nitrate fuel, as described above, and a nitrogen-containing co-fuel. A suitable example of a nitrogen-containing co-fuel is guanidine nitrate. The desirability of use of various co-fuels, such as guanidine nitrate, as a portion of the fuel in a pyrotechnic composition is generally based on a combination of factors, such as burn rate, cost, stability (e.g., thermal stability), availability and compatibility (e.g., compatibility with other standard or useful pyrotechnic composition components).

Further, in certain embodiments, gas generant pyrotechnic compositions may include nitrogen-free fuels. Suitable nitrogen-free pyrotechnic fuels may include carbon, such as amorphous carbon, graphitic carbon, hydrocarbons (compounds comprising hydrogen and carbon), substituted hydrocarbons (hydrocarbons having heteroatoms and/or substituents), like oxygenated hydrocarbons, and alcohols (including polyalcohols), such as pentaerythritol. Such a nitrogen-free pyrotechnic fuels can serve to improve thermal destructive testing performance (e.g., bonfire and slow-heat), as well as serving as an additional fuel source in the gas generant. In certain preferred aspects, the presence of such nitrogen-free pyrotechnic fuels in the gas generant compositions of the present disclosure increases the yield of combustible fuel-rich gas.

The gas generant composition may include combinations of fuels, such that the various fuels may be nominally considered as including a primary fuel, a secondary fuel, a third fuel, and the like. For example, in certain variations, a primary fuel may comprise guanidine nitrate, a secondary fuel may comprise a first nitrogen-free fuel, like elemental carbon (present as amorphous carbon or graphite), and a third fuel may be a second distinct nitrogen-free fuel like a polyalcohol, such as pentaerythritol.

Oxidizers for pyrotechnic compositions are well known in the art, and include, by non-limiting example, alkali, alkaline earth and ammonium nitrate, basic metal nitrates, transition metal complexes of ammonium nitrate, nitrites and perchlorates, metal oxides, and combinations thereof. Advantageously, the oxidizer is selected to provide or result in a propellant composition that in combination with the gaseous oxidizer provided in the stored pressurized gas achieves an effectively high burn rate and gas yield from the pyrotechnic material and substantially combusts and oxidizes the reactants. Specific examples of suitable oxidizers include alkali, alkaline earth, and ammonium nitrates, nitrites, chlorates and perchlorates, metal oxides, basic metal nitrates, transition metal complexes of ammonium nitrate, iodates, permanganates, metal peroxides, metal hydroxy nitrates, and combinations thereof. The oxidizer may be selected, along with a fuel, such as a copper-oxalyldihydrazide complex and/or additional fuel component(s), to form a gas generant that upon combustion achieves an effectively high burn rate and gas yield from the fuel. Specific examples of suitable oxidizers include basic metal nitrates such as basic copper nitrate. Basic copper nitrate has a high oxygen-to-metal ratio and good slag forming capabilities upon burn.

Additional examples of oxidizers include water-soluble oxidizing compounds, such as for example, ammonium nitrate, sodium nitrate, strontium nitrate, potassium nitrate, ammonium perchlorate, sodium perchlorate, and potassium perchlorate. Also included are ammonium dinitramide and perchlorate-free oxidizing agents. The composition may include combinations of oxidizers, such that the various oxidizers may be nominally considered as including a primary oxidizer, a secondary oxidizer, and the like.

In certain preferred aspects, the fuel-rich gas generant formulation may comprise an additional oxidizer selected from the group consisting of ammonium nitrate, potassium perchlorate, sodium nitrate, potassium nitrate, strontium nitrate, equivalents and combinations thereof.

The present gas generants may further include one or more additives, such as binders, coolants, and slag forming agents. The binder component may comprise hydrophilic binders, including hydrophilic binders and/or cellulosic derivatives, thermosetting binders, thermoplastic binders. Examples of suitable binder materials include cellulosics, natural gums, polyacrylates, polyacrylamides, polyurethanes, polybutadienes, polyvinyl alcohols, polyvinyl acetates, and combinations of two or more thereof. More particularly, suitable cellulosic binder materials may include ethyl cellulose, carboxymethyl cellulose, hydroxylpropyl cellulose and combinations of two or more thereof. Suitable natural gum binder materials may include guar, xanthan, arabic and combinations of two or more thereof. Incorporation of binder materials, such as the above-described cellulosic binders, may result in or form compositions that burn at lower temperatures. These "cooler burning" materials may be preferable for certain applications.

The gas generant composition may include a coolant in order to reduce the flame temperature of the gas generant composition, for example. In practice, the composition may include a coolant in the range of up to about 20 weight percent. Suitable coolants include, but are not limited to, oxalic acid, ammonium oxalate, oxamide, ammonium carbonate, calcium carbonate, basic copper carbonate, magnesium carbonate, and combinations thereof.

Additional additives such as slag forming agents, flow aids, plasticizers, viscosity modifiers, pressing aids, dispersing aids, or phlegmatizing agents may also be included in the composition in order to facilitate processing of the gas generant bodies or to provide enhanced properties. For example, compositions may include a slag forming agent such as a metal oxide; e.g., aluminum oxide or silicon dioxide. Generally, such additives may be included in the present compositions in an amount of about 1 to about 5 weight percent.

Suitable slag and viscosity modifying/promoting agents include cerium oxide, ferric oxide, zinc oxide, aluminum oxide, silicon dioxide, titanium oxide, zirconium oxide, bismuth oxide, molybdenum oxide, lanthanum oxide, combinations thereof, and the like. Such redox inert oxides may be employed individually or as mixtures of two or more individual components. For example, where one oxide has a very fine form (e.g., particle size of less than about 20 nm) useful for improving viscosity of a mixture slurry, another coarser oxide having larger particle sizes may be provided to the mixture to improve slagging properties without interfering with or negatively affecting burning rate.

Pressing aids may also be added to the gas generant composition prior to tableting or pressing and include compounds such as calcium or magnesium stearate, graphite, molybdenum disulfide, tungsten disulfide, boron nitride, and mixtures thereof.

In some embodiments, one or more of the materials or components included in the gas generant may serve more than one role or function. For example, binder materials or pressing aids may also act or function as a fuel component, as described herein. Thus, specific range limits for particular materials that may be included in the present compositions are generally dependent, at least in part, on what other particular materials are included. Ranges for particular materials can be identified by those skilled in the art and guided by the teachings provided herein.

As discussed above, in certain preferred variations, a linear burn rate is at least 0.75 inches per second at a pressure of about 3,000 psi (about 21 MPa). Certain materials considered to be particularly suitable for meeting such a burn rate parameter for use in the fuel-rich gas generant grain, include: a fuel selected from the group consisting of: guanidine nitrate, elemental carbon, guanylurea nitrate, melamine, cyanuric acid, nitroguanidine, nitrotriazolone, barbituric acid, nitrobarbituric acid, salts of nitrobarbituric acid, aminoguanidine and salts thereof, diamminoguanidine and salts thereof, and combinations thereof. Optionally a nitrogen-free pyrotechnic fuel may also be included, such as amorphous carbon, graphitic carbon, hydrocarbons, oxygenated hydrocarbons, polyalcohols, and combinations thereof. Likewise, the fuel-rich gas generant grain in certain preferred variations may comprise an oxidizer selected from the group consisting of: ammonium perchlorate, cupric oxide, ammonium nitrate, potassium perchlorate, sodium nitrate, potassium nitrate, strontium nitrate, and combinations thereof. An optional binder may be present in the fuel-rich gas generant grain, which is selected from the group consisting of: ethylcellulose, hydroxypropyl cellulose, polyvinyl alcohol, polyacryamide, methyl cellulose, and combinations thereof and an optional inert additive may also be included in certain embodiments of a fuel-rich gas generant selected from the group consisting of: silica, alumina, zirconia, lanthanum oxide, and combinations thereof.

Thus, in certain embodiments, a fuel-rich gas generant grain has a composition comprising a fuel, an oxidizer, an optional binder, and an optional inert additive. The fuel can be selected from the group consisting of: guanidine nitrate, elemental carbon, guanylurea nitrate, melamine, cyanuric acid, nitroguanidine, nitrotriazolone, barbituric acid, nitrobarbituric acid, salts of nitrobarbituric acid, aminoguanidine and salts thereof, diamminoguanidine and salts thereof, and combinations thereof. Optionally a nitrogen-free pyrotechnic fuel may also be included, such as amorphous carbon, graphitic carbon, hydrocarbons, oxygenated hydrocarbons, polyalcohols, and combinations thereof. The oxidizer can be selected from the group consisting of: ammonium perchlorate, cupric oxide, ammonium nitrate, potassium perchlorate, sodium nitrate, potassium nitrate, strontium nitrate, and combinations thereof. The optional binder can be selected from the group consisting of: ethylcellulose, hydroxypropyl cellulose, polyvinyl alcohol, polyacryamide, methyl cellulose, and combinations thereof. The optional inert additive can be selected from the group consisting of: silica, alumina, zirconia, lanthanum oxide, and combinations thereof.

In certain preferred aspects, fuel-rich gas generant compositions found to exhibit desired ballistic properties for use in the inflator devices of the present disclosure contain a primary oxidizer comprising ammonium perchlorate at greater than or equal to about 10% by mass to less than or equal to about 50% by mass and a secondary oxidizer comprising cupric oxide at greater than or equal to about 10% by mass to less than or equal to about 15% by mass. Further, such a desirable fuel-rich gas generant composition comprises a primary fuel comprising guanidine nitrate at greater than or equal to about 30% by mass to less than or equal to about 70% by mass and a secondary fuel comprising elemental carbon, present as amorphous carbon or graphite, at greater than or equal to about 0.5% to less than or equal to about 15% and an optional third fuel comprising pentaerythritol at greater than or equal to about 1% to less than or equal to about 10% by total mass of the gas generant grain.

In other aspects, an initiator pyrotechnic material is similar to that of a gas generant pyrotechnic material, but typically has a more rapid burn time, higher rate of reaction, and/or lower ignition temperature, so that it may serve the role of rapidly initiating combustion through the initiator device, while generating a shock wave of combustion gas. In certain aspects, suitable initiator or booster fuel materials include ethyl cellulose, nitrocellulose, metal hydride pyrotechnic materials such as zirconium hydride potassium perchlorate (ZHPP) and titanium hydride potassium perchlorate (THPP), zirconium potassium perchlorate (ZPP), boron potassium nitrate ($BKNO_3$), cis-bis-(5-nitrotetrazolato)tetramine cobalt (III)perchlorate (BNCP), and mixtures thereof. In certain variations, a particularly preferred initiator fuel is titanium hydride potassium perchlorate (THPP). Some of these initiator fuels, such as ethyl cellulose, may require the inclusion of an oxidizer (discussed above in the context of the gas generant pyrotechnic compositions). The initiator material may also further include other components typically included in the gas generant or initiator compositions, as appreciated by those of skill in the art.

Under certain operating conditions, the initiator material can generate partially oxidized byproducts in a similar manner to the gas generant material. Thus, in certain aspects, the pressurized storage gas media comprising at least one oxidant, such as a gaseous oxidizer, can further react with the combustion gas generated by the initiator material. It has been surprisingly discovered that inflator systems employing a stored gas component with at least one oxidant, such as oxygen present at about 20% by volume, are significantly more reliable with respect to inflator function (e.g., have greater reliability for inflator deployment). As discussed above, with a blow-down inflator device configuration, energy must be conveyed from the initiator end of the inflator to the opposite diffuser end, where the energy actuates a temporary closure or burst disc to release stored gas from the inflator device. It has been unexpectedly discovered that inert stored gas is significantly less efficient at conveying sufficient energy to rupture the temporary closure/burst disc than a pressurized stored gas media containing an oxidant, like oxygen, in accordance with the inventive technology.

Particularly beneficial results are realized when such a pressurized storage gas comprising oxygen is used with an initiator material that is also fuel rich (similar to the fuel-rich gas generant compositions described above). While not wishing to be bound by any particular theory, it is believed that this phenomena appears to involve hydrogen (both atomic H and $H_2$) formed by combustion of the initiator material. For example, in certain variations, an initiator material may be a conventional initiator composition that comprises THPP and has an equivalence ratio of about 1.16. When the initiator material is actuated and combusts, it forms at least in part the hydrogen species discussed above. Such hydrogen, it is believed, reacts with the oxidant in the pressurized storage media (e.g., oxygen), and thus contributes to significantly increased shock wave intensity with potential increases in both magnitude and duration of the shock wave generated.

The embodiments of the present disclosure can be further understood by the specific examples contained herein. Specific examples are provided for illustrative purposes of how to make and use the compositions and methods of the present disclosure and, unless explicitly stated otherwise, are not intended to be a representation that given embodiments of this present disclosure have, or have not, been made or tested.

Example I

A monolithic gas generant grain according to the present teachings (Example 1) is prepared by charging guanidine nitrate (128.6 kg), ammonium perchlorate (56.6 kg), cupric oxide (22.7 kg) and graphite powder (18.8 kg) to 40 gallons of hot water. The fuel components are provided in excess of the oxidant components in the gas generant, therefore the gas generant material of Example 1 is fuel-rich and has an equivalence ratio of 1.67. The slurried mixture is then spray dried.

A release agent (e.g., calcium stearate) is optionally dry blended with the spray dried composition. The blended powder is placed in a pre-formed die having the desired shape, such as the star-shaped gas generant grain shown in FIG. 5, for example. The die and powders are placed in a large, high tonnage hydraulic press capable of exerting forces in excess of 50 tons. The raw materials are pressed to form a monolithic gas generant solid. Examples 2 and 3 are also prepared with the same materials via the same technique.

Likewise, Comparative Example A, representative of a conventional gas generant material is prepared by charging guanidine nitrate (270.9 kg), basic copper nitrate (117.9 kg), potassium perchlorate (63.5 kg) and silicon dioxide (1.2 kg) to 80 gallons of hot water. The slurried mixture is then spray dried and pressed into the same shape as described above. The fuel components are provided in more or less stoichiometric amounts to the oxidant components in the gas generant, therefore the gas generant material of Comparative Example A has an equivalence ratio of about 1.025.

Examples 1-3 and Comparative Example A gas generants are tested in a blow-down inflator configuration similar to that shown in FIGS. 3 and 4, where a gas exit end is sealably contained in a fixed volume (a 1 cubic foot ($ft^3$) tank rather than an airbag cushion 208) to quantify relative inflator device performance. Examples 1-3 and Comparative Example A are tested in the same blow-down inflator device having a 1 cubic foot volume tank; however, the gas generant in Example 1 is stored in a pressurized gas mixture of 20% oxygen, 20% helium, and 60% argon at approximately 54 MPa. The gas generant of Example 2 is stored in a pressurized gas mixture of 15% oxygen, 20% helium, and 65% argon at approximately 54 MPa, while the gas generant of Example 3 is stored in a pressurized gas mixture of 10% oxygen, 20% helium, and 70% argon at approximately 54 MPa.

On the other hand, the gas generant of Comparative Example A is stored in a conventional pressurized gas mixture lacking any oxidant and having only inert gases (a mixture of 75% Argon and 25% Helium) at 54 MPa. Examples 1-3 and Comparative Example A are ignited at the same time (at approximately 2-3 milliseconds) and have similar pressure curves (neutral to progressive).

FIG. 6 is a graph showing combustion pressure versus time for a gas generant monolithic grain formed according to Example I and stored in a pressurized gas having an oxidant present. A comparative conventional stoichiometric monolithic gas generant grain is prepared as Comparative Example A in the same inflator device configuration, but lacks any oxidant in the stored pressurized gas. As can be observed from FIG. 6, Comparative Example A generates a peak combustion pressure of only about 530 kPa around 60 milliseconds. Example 1 desirably generates a much higher peak combustion pressure of about 720 kPa around 60 milliseconds. The maximum rise rate is 100.2 kPa/5 milliseconds (for Example 1); a final chamber temperature is 267 K, inflating flow rate is 1.771 Kmol*K, where wall temperatures are about 329.6 K and chamber energies are 1.91 J. A mass average exit gas temperature (EGT) is an averaged inflator property and here is 356.1 K. Typical inflator systems are optimized to have an EGT of approximately 350 K. Thus, the fuel-rich gas generant of Example I in combination with the pressurized gas having an oxidant species provides a significant increase in overall combustion pressure within nearly the same timeframe as Comparative Example A.

Examples 1-3 have differing amounts of gaseous oxidant in the pressurized storage gas. Example 1 has 20% oxygen content, while Example 2 has 15% oxygen content, and Example 3 has 10% oxygen content. This experiment shows that oxygen content elicits a trend in inflator device performance as evidenced by an incrementally increasing pressure within the 1 cubic foot test tank when oxygen is incrementally increased in the stored pressurized inflation media.

Furthermore, the inventive technology provides a surprising advantage in scavenging and thus reducing noxious effluent species from the inflator effluent gas at a high efficiency. As can be seen from the data, fuel-rich monolithic grains produce effluent constituents are well below 10% of the USCAR guidelines on various effluent constituents. Thus, the inflator systems of the present disclosure demonstrate a beneficial overall reduction in various effluent constituents versus traditional inflator systems. In FIG. 7, the percentage of the allowed limit of undesirable effluent species is shown. For example, $Cl_2$ and carbon monoxide are both below 10% of the applicable chlorine and carbon monoxide limits, while $CO_2$, NO, $NO_2$, and phosgene ($COCl_2$) are well below 5% of the applicable limits, while $NH_3$, benzene ($C_6H_6$), formaldehyde, HCl, NCN, $H_2S$, $SO_2$, and total airborne (e.g., particulates, aerosols) are well below 1% the applicable limits.

Effluent from inflator devices of the present technology employing fuel-rich gas generant compositions surprisingly burned more cleanly with fewer undesirable effluent species than a well-balanced (e.g., near stoichiometric fuel to oxidant ratio) gas generant formulations that should theoretically likewise burn cleanly. While not limiting the present teachings to any particular theory, it is speculated that the high temperature combustion of the gaseous fuels of the inventive technology allows complete combustion of partially oxidized fuel species, such as CO and $H_2$. Further, the low overall temperature in the chamber fortuitously and unexpectedly appears to suppress the formation of nitrogen oxides ($NO_x$) and other over-oxidized effluent species.

Example II

Monolithic gas generant grains are formed as described above in Example I to form gas generants for Example 4 and Comparative Example B. A conventional initiator pyrotechnic material comprising titanium hydride potassium perchlorate (THPP) is used for both Example 4 and Comparative Example B. The initiator material is fuel-rich and has an equivalence ratio of about 1.6. The initiator and gas generant materials of Example 4 and Comparative Example B are tested in a test device having a blow-down inflator configuration like the one described in the context of Example I above (attached to a fixed 1 $ft^3$ volume tank rather than an actual airbag cushion 208) to quantify relative inflator device performance.

Example 4 and Comparative Example B are tested in the same blow-down inflator device; however, the gas generant in Example 4 is stored in a storage chamber of the inflator device that holds a pressurized stored gas mixture of 20% oxygen, 20% helium, and 60% argon at a pressure of approximately 54 MPa. The gas generant of Comparative Example B is stored in a conventional pressurized storage gas mixture lacking any oxidant and having only inert gases (a mixture of 75% Argon and 25% Helium) at a pressure of approximately 54 MPa. The pressurized storage gases of both Example 4 and Comparative Example B are respectively stored at −40° C. Example 4 and Comparative Example B are ignited at the same time (at approximately 2-3 milliseconds).

FIG. 8 reflects the comparative data from these experiments demonstrating enhanced inflator reliability for inflator devices of Example 4, as compared to reliability of inflator systems of Comparative Example B. 105 different tests were run for inflator systems like Example 4 and 100 tests of Comparative Example B to generate the statistical analysis Binary Logistic Regression data shown in FIG. 8. Binary Logistic Regression (BLR) is used to determine reliability based on attribute data of inflator devices of airbag systems (demonstrating either deployment or no deployment of the airbag) coupled with gas load data (g). Here, inflator reliability can be determined with the Binary Logistic Regression model showing the statistical probability of air bag curtain deployment (% probability of deployment) versus gas weight (in grams).

A typical minimum requirement for an airbag inflator is 6 nines reliability at a nominal (120 g) gas load. As the quantities of gas fill media (pressurized stored gas) in the storage chamber are reduced, so too is the ability of such stored gas to convey energy to the burst disc. Total gas fill content can be incrementally reduced to force inflators through a pass (deployed) to fail (failed to deploy) transition. As can be seen in FIG. 8, Comparative Example B has 6 nines reliability at 60 g gas load. In comparison, the oxygenated gas design of Example 4 demonstrates significantly improved performance with 7 nines reliability at a mere 24 g gas load. Accordingly, reliability of inflator systems prepared in accordance with certain aspects of the present teachings is significantly improved over identical airbag systems, having the same hardware components, gas generant(s), and initiator material(s), but lacking oxidant (e.g., oxygen) in the pressurized gas stored in the chamber.

Another way to demonstrate improved reliability of an inflator device for an airbag system is through "50/50" deployment testing. A quantity of stored gas is determined where 50% of the airbag curtains deploy and 50% fail to deploy, which can be used as a comparative measure of performance and reliability. As noted above, as the quantity of stored gas fill media in the storage chamber of the inflator device is reduced, so too is the ability of such stored gas to convey energy to the burst disc. Thus, a comparatively low amount of stored gas at the 50/50 point for a given inflator system demonstrates improved performance and reliability. With conventional inflator designs, such as that in Comparative Example B (having the same hardware components, gas generant(s), and initiator material(s), but lacking oxidant (e.g., oxygen) in the pressurized gas stored in the chamber), 50% of the airbags will fail to deploy and 50% will function and deploy where about 41 g of stored gas media is present in the storage chamber of the inflator device. With certain embodiments of the inventive technology, it has been observed that 50% of the airbags fail to deploy and 50% function and deploy with about 17 g of stored gas media (having 20% oxygen oxidant in the stored gas media, like in Example 4), meaning that half the inflators will function to deploy an airbag and half will not function where only 17 g of stored gas is present. Through such 50/50 deployment point testing, conventional inflators are shown to be less reliable (requiring higher amounts of stored gas) than the inventive inflators prepared in accordance with certain aspects of the present disclosure (requiring significantly less stored gas to have the same reliability level).

Inflator systems in FIG. 8, like Example 4, having a stored compressed gas with at least one oxidant (e.g., oxygen as a stored gas component present at 20%) are significantly more likely to deploy and therefore are significantly more reliable with respect to inflator function in the airbag system. This is a very desirable improvement in inflator performance and these results are surprising and unexpected. Furthermore, in certain aspects, relatively large volume airbag curtains may have difficulty meeting minimum functional reliability requirements when used with conventional inflator systems. However, when combined with the inventive inflator devices of certain aspects of the present technology, such large volume airbags are capable of not only meeting, but also exceeding the minimum functional reliability requirements to facilitate their commercial use.

Thus, in certain aspects, the present disclosure provides improved reliability for an inflator system according to the present teachings comprising a pressurized storage gas comprising at least one oxidant, as compared to a comparative inflator system having a pressurized storage gas that lacks any such oxidant. In certain variations, particularly suitable pressurized gases have an average molecular weight of greater than or equal to about 20 g/mol to less than or equal to about 40 g/mol, especially those that have an average molecular weight of greater than or equal to about 30 g/mol to less than or equal to about 32 g/mol, and in certain preferred aspects, the average molecular weight is about 31 g/mol. In certain preferred aspects, the oxidant comprises oxygen ($O_2$). Further, in certain aspects, the pressurized storage gas comprises a total amount of about 20% by volume of oxygen and/or any the other oxidant(s).

Thus, in certain aspects, the present teachings provide a method of improving inflator device reliability for an airbag system. An initiator device is provided in actuating proximity to a gas generant grain. The gas generant grain defines at least one flow channel from a first side to a second opposite side. The inflator device further comprises a chamber storing a pressurized gas comprising at least one gaseous oxidizer. The oxidizers discussed above are suitable, however in certain preferred variations; the pressurized gas comprises oxygen ($O_2$) as an oxidizer. In certain variations, the pressurized gas comprises oxygen ($O_2$) present in the pressurized gas at about 20% by volume. One particularly suitable pressurized gas that serves to improve airbag deployment reliability comprises about 20% by volume oxygen, about 20% by volume helium, and about 60% by volume argon.

In certain variations, the pressurized gas has an average molecular weight of greater than or equal to about 20 g/mol to less than or equal to about 40 g/mol. In certain preferred aspects, the pressurized gas optionally has an average molecular weight of greater than or equal to about 30 g/mol to less than or equal to about 32 g/mol. Upon actuating the initiator device, a shock wave is generated that propagates through the flow channel of the gas generant grain so as to open a temporary closure to permit fluid communication between the chamber and the airbag to permit deployment of the airbag. The present teachings provide for improved reliability for deployment of the airbag for the inventive systems over a comparative airbag system having exactly the same components, but lacking any oxidant like oxygen in the pressurized gas.

In certain aspects, an improved reliability of an airbag inflator device and airbag system in accordance with such embodiments is reflected by successful airbag deployment for 50% of airbag systems (and 50% deployment failure or the so-called 50/50 deployment point) in a test device like those described above, including a storage chamber for containing the pressurized gas with at least one gaseous oxidizer gas media. Thus, an improved reliability of the airbag inflator device is reflected by a 50/50 deployment point in a test device with less than or equal to about 30 g of the pressurized gas with the at least one gaseous oxidizer gas media; optionally less than or equal to about 25 g; optionally less than or equal to about 20 g; optionally in certain variations at about 17 g of pressurized gas comprising at least one gaseous oxidizer.

In certain other aspects, an improved reliability of airbag systems prepared in accordance with certain embodiments of the present teachings is reflected by a Binary Logistic Regression (BLR) in a test device like those described above having 7 nines reliability at less than or equal to about 40 g of pressurized gas comprising the at least one gaseous oxidizer gas media in the storage chamber; optionally 7 nines reliability at less than or equal to about 35 g of pressurized gas; optionally 7 nines reliability at less than or equal to about 30 g of pressurized gas; optionally 7 nines reliability at less than or equal to about 25 g of pressurized gas; and in certain aspects, optionally 7 nines reliability at about 24 g of pressurized gas comprising at least one gaseous oxidizer.

In certain aspects, the present disclosure provides a method for inflating an airbag. The method comprises providing an inflator device that includes an initiator material in actuating proximity to a gas generant grain. In certain aspects, the gas generant material is fuel-rich. Further, the inflator device further comprises a chamber that stores pressurized gas comprising at least one oxidizer that is capable of reacting with the fuel-rich gas generant (or with products made by the gas generant as it combusts after it is ignited by the initiator device). The initiator material is capable of forming a shock wave upon receipt of a signal. In certain variations, the initiator material is also fuel-rich. The shock wave passes through a flow channel disposed in the gas generant grain (extending from a first side to a second opposite side of the gas generant grain).

After the shock wave passes through the gas generant grain, it opens a temporary closure between the storage chamber and the air bag to permit fluid communication and inflate the airbag. Additionally, a component contained in the gas generant material, a component generated by the gas generant material, or both, combusts and reacts with at least a portion of the oxidant in the stored pressurized gas to generate a portion of the combustion gas formed by the gas generant material. Further, a component contained in the initiator material, a component generated by the initiator material, or both, can combust and react with at least a portion of the oxidant in the stored pressurized gas to generate at least a portion of the combustion gas/shock wave formed by the initiator material. The airbag is inflated by both the combustion gas (whether contributed by the gas generant material or initiator device) and at least a portion of the stored pressurized gas. Such methods employ any of the apparatuses and compositions described above and are particularly useful for situations where the airbag has a fill volume of greater than or equal to about 60 liters (as discussed above). As noted previously, after actuation of the initiator device, in certain embodiments, the airbag is substantially inflated in less than or equal to about 25 milliseconds. Furthermore, such methods provide significantly and surprisingly reduced regulated and/or undesirable noxious effluent species, as outlined above.

In yet other aspects, the present teachings provide methods for improving reliability of an airbag system. Improvement of reliability includes improving the reliability of timely deployment of an airbag after actuation in response to a trigger event. For example, in one embodiment, the method includes providing the airbag system comprising an initiator device in actuating proximity to a gas generant grain. The gas generant grain comprises at least one flow channel. The method includes introducing a pressurized gas comprising at least one gaseous oxidizer into a storage chamber. The presence of the at least one gaseous oxidizer in the pressurized gas introduced into the storage chamber improves airbag deployment reliability.

In various embodiments, the pressurized gas comprises at least one oxidizer. In preferred aspects, the pressurized gas comprises oxygen ($O_2$) as an oxidizer. In certain aspects, the pressurized gas has an average molecular weight of greater than or equal to about 20 g/mol to less than or equal to about 40 g/mol; optionally greater than or equal to about 30 g/mol to less than or equal to about 32 g/mol. In certain variations, the pressurized gas comprises oxygen ($O_2$) present in the pressurized gas at about 20% by volume. One particularly suitable pressurized gas that serves to improve airbag deployment reliability comprises about 20% by volume oxygen, about 20% by volume helium, and about 60% by volume argon.

The initiator device is capable of generating a shock wave upon actuation that propagates through the flow channel(s) of the gas generant grain. The shock wave opens a temporary closure to permit fluid communication between the chamber and the airbag, thus serving to deploy the airbag. In certain embodiments, the reliability of the airbag system is particularly improved when the initiator material is fuel-rich and has an equivalence ratio of greater than 1. Furthermore, certain variations of the inventive technology significantly increase the deployment reliability of inflator systems for large volume airbag curtains, when the stored pressurized gas has an average molecular weight of greater than or equal to about 20 g/mol to less than or equal to about 40 g/mol, and in certain preferred aspects, comprises an oxidant like oxygen.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An inflator device for an airbag, comprising:

a housing comprising an initiator device in actuating proximity to a fuel-rich gas generant grain comprising at least one flow channel, wherein the fuel-rich gas generant grain produces a combustion gas to inflate the airbag and has an equivalence ratio of greater than or equal to about 1.33 to less than or equal to about 1.8, wherein the housing further comprises a chamber storing a pressurized gas comprising at least one gaseous oxidizer capable of reacting with a component contained in or generated by the fuel-rich gas generant grain; and a temporary closure disposed in the housing to restrict fluid communication between the chamber and the airbag, wherein upon actuation, the initiator device generates a shock wave that propagates through said at least one flow channel of the fuel-rich gas generant grain so as to open the temporary closure to permit fluid communication between the chamber and the airbag.

2. The inflator device of claim 1, wherein the pressurized gas has an average molecular weight of greater than or equal to about 20 g/mol to less than or equal to about 40 g/mol.

3. The inflator device of claim 1, wherein the pressurized gas has an average molecular weight of greater than or equal to about 30 g/mol to less than or equal to about 32 g/mol.

4. The inflator device of claim 1, wherein the at least one gaseous oxidizer is selected from the group consisting of: oxygen ($O_2$), nitrous oxide ($N_2O$), and combinations thereof.

5. The inflator device of claim 1, wherein the pressurized gas comprises greater than to about 10% to less than or equal to about 20% by volume oxygen, about 20% by volume helium, and greater than or equal to about 60% to less than or equal to about 70% by volume argon.

6. The inflator device of claim 1, wherein the pressurized gas is stored in the chamber at a pressure of greater than or equal to about 7,000 psia (48 MPa) to less than or equal to about 10,500 psia (72 MPa).

7. The inflator device of claim 1, wherein when the temporary closure opens, at least a portion of the pressurized gas and at least a portion of the combustion gas enter the airbag for inflation.

8. The inflator device of claim 1, wherein the airbag has a fill volume of greater than or equal to about 60 liters.

9. The inflator device of claim 1, wherein the airbag has a fill volume of greater than or equal to about 75 liters.

10. The inflator device of claim 1, wherein the fuel-rich gas generant grain has a composition comprising:

a fuel selected from the group consisting of: guanidine nitrate, elemental carbon, guanylurea nitrate, melamine, cyanuric acid, nitroguanidine, nitrotriazolone, barbituric acid, nitrobarbituric acid, salts of nitrobarbituric acid, aminoguanidine and salts thereof, diamminoguanidine and salts thereof, and combinations thereof;

an oxidizer selected from the group consisting of: ammonium perchlorate, cupric oxide, ammonium nitrate, potassium perchlorate, sodium nitrate, potassium nitrate, strontium nitrate, and combinations thereof;

an optional binder selected from the group consisting of: ethylcellulose, hydroxypropyl cellulose, polyvinyl alcohol, polyacrylamide, methyl cellulose, and combinations thereof; and an optional inert additive selected from the group consisting of: silica, alumina, zirconia, lanthanum oxide, and combinations thereof.

11. The inflator device of claim 1, wherein the fuel-rich gas generant grain has a composition comprising:

a first fuel comprising guanidine nitrate at greater than or equal to about 30% to less than or equal to about 70% by total mass of the fuel-rich gas generant grain;

a second fuel comprising elemental carbon at greater than or equal to about 0.5% to less than or equal to about 15% by total mass of the fuel-rich gas generant grain;

an optional third fuel comprising pentaerythritol at greater than or equal to about 1% to less than or equal to about 10% by total mass of the fuel-rich gas generant grain;

a first oxidizer comprising ammonium perchlorate at greater than or equal to about 10% to less than or equal to about 50% by total mass of the fuel-rich gas generant grain; and a second oxidizer comprising cupric oxide at greater than or equal to about 1% to less than or equal to about 15% by total mass of the fuel-rich gas generant grain.

12. An inflator device for an airbag, comprising:

a housing comprising an initiator device in actuating proximity to a fuel-rich gas generant grain comprising at least one flow channel, wherein the fuel-rich gas generant grain has an equivalence ratio of greater than or equal to about 1.33 to less than or equal to about 1.8 and produces a combustion gas to inflate the airbag and is at least partially disposed within a chamber storing a pressurized gas comprising oxygen ($O_2$) capable of reacting with a component contained in or generated by the fuel-rich gas generant grain, wherein the pressurized gas has an average molecular weight of greater than or equal to about 20 g/mol to less than or equal to about 40 g/mol; and a temporary closure disposed in the housing to restrict fluid communication between the chamber and the airbag, wherein upon actuation, the initiator device generates a shock wave that propagates through said at least one flow channel of the fuel-rich gas generant grain so as to open a temporary closure to permit fluid communication between the chamber and the airbag so that at least a portion of the pressurized gas and at least a portion of the combustion gas enters the airbag for inflation.

13. The inflator device of claim 12, wherein the airbag has a fill volume of greater than or equal to about 60 liters.

14. The inflator device of claim 12, wherein the fuel-rich gas generant grain has an equivalence ratio of greater than or equal to about 1.33 to less than or equal to about 1.67.

15. The inflator device of claim 12, wherein the fuel-rich gas generant grain has a composition comprising:

a fuel selected from the group consisting of: guanidine nitrate, elemental carbon, guanylurea nitrate, melamine, cyanuric acid, nitroguanidine, nitrotriazolone, barbituric acid, nitrobarbituric acid, salts of nitrobarbituric acid, aminoguanidine and salts thereof, diamminoguanidine and salts thereof, and combinations thereof;

an oxidizer selected from the group consisting of: ammonium perchlorate, cupric oxide, ammonium nitrate, potassium perchlorate, sodium nitrate, potassium nitrate, strontium nitrate, and combinations thereof;

an optional binder selected from the group consisting of: ethylcellulose, hydroxypropyl cellulose, polyvinyl alcohol, polyacrylamide, methyl cellulose, and combinations thereof; and an optional inert additive selected from the group consisting of: silica, alumina, zirconia, lanthanum oxide, and combinations thereof.

16. The inflator device of claim 12, wherein the fuel-rich gas generant grain has a composition comprising:

a first fuel comprising guanidine nitrate at greater than or equal to about 30% to less than or equal to about 70% by total mass of the fuel-rich gas generant grain;

a second fuel comprising elemental carbon at greater than or equal to about 0.5% to less than or equal to about 15% by total mass of the fuel-rich gas generant grain;

an optional third fuel comprising pentaerythritol at greater than or equal to about 1% to less than or equal to about 10% by total mass of the fuel-rich gas generant grain;

a first oxidizer comprising ammonium perchlorate at greater than or equal to about 10% to less than or equal to about 50% by total mass of the fuel-rich gas generant grain; and a second oxidizer comprising cupric oxide at greater than or equal to about 1% to less than or equal to about 15% by total mass of the fuel-rich gas generant grain.

17. A method for inflating an airbag comprising:

providing an initiator device in actuating proximity to a fuel-rich gas generant grain comprising at least one flow channel, wherein the fuel-rich gas generant grain is at least partially disposed within a chamber storing a pressurized gas comprising at least one gaseous oxidizer capable of reacting with a component contained in or generated by the fuel-rich gas generant grain and wherein the fuel-rich gas generant grain has an equivalence ratio of greater than or equal to about 1.33 to less than or equal to about 1.8;

wherein upon actuating the initiator device, a shock wave is generated that propagates through said at least one flow channel of the fuel-rich gas generant grain so as to open a temporary closure to permit fluid communication between the chamber and the airbag, wherein after the actuating, the gaseous oxidizer reacts with the component to generate a combustion gas, so that the airbag is inflated by the combustion gas and at least a portion of the pressurized gas.

18. The method of claim 17, wherein the airbag has a fill volume of greater than or equal to about 60 liters and is substantially inflated after the actuating in less than or equal to about 25 milliseconds.

19. An inflator device for an airbag, comprising:

a housing comprising an initiator device in actuating proximity to a fuel-rich gas generant grain comprising at least one flow channel and having an equivalence ratio of greater than or equal to about 1.33 to less than or equal to about 1.8, wherein the gas generant grain produces a combustion gas to inflate the airbag, wherein the housing further comprises a chamber storing a pressurized gas comprising at least one gaseous oxidizer capable of reacting with a component contained in or generated by either the initiator device or the gas generant grain, wherein the pressurized gas has an average molecular weight of greater than or equal to about 20 g/mol to less than or equal to about 40 g/mol; and a temporary closure disposed in the housing to restrict fluid communication between the chamber and the airbag, wherein upon actuation, the initiator device generates a shock wave that propagates through said at least one flow channel of the gas generant grain so as to open the temporary closure to permit fluid communication between the chamber and the airbag.

20. The inflator device of claim 19, wherein the pressurized gas has an average molecular weight of greater than or equal to about 30 g/mol to less than or equal to about 32 g/mol.

21. The inflator device of claim 19, wherein the at least one gaseous oxidizer is present in the pressurized gas at about 20% by volume.

22. The inflator device of claim 19, wherein the at least one gaseous oxidizer comprises oxygen ($O_2$).

23. The inflator device of claim 19, wherein the pressurized gas comprises about 20% by volume oxygen, about 20% by volume helium, and about 60% by volume argon.

24. The inflator device of claim 19, wherein the initiator device comprises an initiator composition that is fuel-rich.

25. A method of improving reliability of an airbag system comprising:

introducing a pressurized gas comprising at least one gaseous oxidizer into a storage chamber of an airbag inflator device, wherein the pressurized gas has an average molecular weight of greater than or equal to about 20 g/mol to less than or equal to about 40 g/mol, and the airbag system further comprises an initiator device in actuating proximity to a fuel-rich gas generant grain comprising at least one flow channel and having an equivalence ratio of greater than or equal to about 1.33 to less than or equal to about 1.8;

wherein the initiator device is capable of generating a shock wave upon actuation that propagates through said at least one flow channel of the gas generant grain and the storage chamber so as to open a temporary closure to permit fluid communication between the storage chamber and the airbag thereby deploying the airbag, wherein the presence of the at least one gaseous oxidizer improves airbag deployment reliability.

26. The method of claim 25, wherein an improved reliability of the airbag inflator device is reflected by a 50/50 deployment point corresponding to less than or equal to about 30 g of the pressurized gas in the storage chamber.

27. The method of claim 26, wherein the improved reliability of the airbag inflator device is reflected by the 50/50 deployment point corresponding to about 17 g pressurized gas comprising the at least one gaseous oxidizer gas media in the storage chamber.

28. The method of claim 25, wherein an improved reliability of the airbag inflator device is reflected by Binary Logistic Regression (BLR) in a test device having 7 nines reliability at less than or equal to about 40 g of the pressurized gas in the storage chamber.

29. The method of claim 28, wherein the improved reliability of the airbag inflator device is reflected by the BLR having 7 nines reliability at about 24 g of the pressurized gas in the storage chamber.

30. The method of claim 25, wherein the pressurized gas has an average molecular weight of greater than or equal to about 30 g/mol to less than or equal to about 32 g/mol.

31. The method of claim 25, wherein the at least one gaseous oxidizer comprises oxygen ($O_2$) present in the pressurized gas at about 20% by volume.

32. The method of claim 25, wherein the pressurized gas comprises about 20% by volume oxygen, about 20% by volume helium, and about 60% by volume argon.

33. The inflator device of claim 25, wherein the initiator device comprises an initiator composition that is fuel-rich.

* * * * *